US007485359B2

(12) United States Patent
Tamagawa

(10) Patent No.: US 7,485,359 B2
(45) Date of Patent: Feb. 3, 2009

(54) SUPPORT FOR IMAGE-RECORDING MATERIAL AND IMAGE-RECORDING MATERIAL

(75) Inventor: Shigehisa Tamagawa, Shizuoka (JP)

(73) Assignee: Fuji Photo Film Co., Ltd., Minami-Ashigara-Shi (JP)

( * ) Notice: Subject to any disclaimer, the term of this patent is extended or adjusted under 35 U.S.C. 154(b) by 505 days.

(21) Appl. No.: 11/223,207

(22) Filed: Sep. 12, 2005

(65) Prior Publication Data

US 2006/0058188 A1 Mar. 16, 2006

(30) Foreign Application Priority Data

Sep. 13, 2004 (JP) ..... 2004-266126

(51) Int. Cl.
*G03G 5/10* (2006.01)

(52) U.S. Cl. ..... 428/141; 428/211.1

(58) Field of Classification Search ..... None
See application file for complete search history.

(56) References Cited

FOREIGN PATENT DOCUMENTS

| | | |
|---|---|---|
| JP | 6-3768 | 1/1994 |
| JP | 6-324431 | 11/1994 |
| JP | 7-270969 | 10/1995 |
| JP | 2001-63204 | 3/2001 |
| JP | 2001-337416 | 12/2001 |

*Primary Examiner*—Bruce H Hess
(74) *Attorney, Agent, or Firm*—Kratz, Quintos & Hanson, LLP

(57) ABSTRACT

The object of the present invention is to provide a support for image-recording material that is recordable on both surfaces with less show-through, has an excellent adhesion resistance and texture, and can record high gloss, high quality images. Accordingly, provided is a support for an image-recording material which has a paper and one polymer-coated layer on both surfaces of the paper, wherein polymer-coated layers on both surfaces of the paper comprise titanium dioxide, and each outermost surface of polymer-coated layers on both surfaces of the paper is a roughened surface.

13 Claims, 3 Drawing Sheets

SUPPORT FOR IMAGE-RECORDING MATERIAL AND IMAGE-RECORDING MATERIAL

BACKGROUND OF THE INVENTION

1. Field of the Invention

The present invention relates to a support for image-recording material and an image-recording material having such a support that is recordable on both surfaces with less show-through, has an excellent adhesion resistance and texture, and can record high gloss, high quality images.

2. Description of the Related Art

Conventionally, raw paper, synthetic paper, synthetic resin sheets, coated paper and laminated paper, and the like, for example, are used as supports for various image-recording materials such as electrophotographic material, thermosensitive material, inkjet-recording material, sublimation transfer material, silver salt photographic material, thermal transfer material, and the like. And of all others, coated paper and laminated paper are ones preferred.

For example, a support for photographic-developing paper with at least one layer of resin such as polyolefin, polyethylene terephthalate, and the like, on both surfaces of the raw paper is suggested in Japanese Patent Application Laid-Open (JP-A) Nos. 7-270969, 6-3768, 6-324431, and 2001-337416. The inkjet-recording material that comprises a support with polyolefin resin layer on both surfaces of the raw paper is suggested (JP-A No. 2001-63204). At these suggestions, because only one surface of the support has an image-recording layer and recording on both surfaces is not planned, when both surfaces are recorded, occurrence of show-through cannot be prevented. Furthermore, there is a disadvantage of lesser adhesion resistance.

Therefore, a support for image-recording material and an image-recording material having such a support with following properties: comprises at least one polymer-coated layer on both surfaces of raw paper, is recordable on both surfaces with less show-through, have an excellent adhesion resistance and texture, and can record high gloss, high quality images, have not been obtained and in the present state of affairs, their soon supply is desirable.

SUMMARY OF THE INVENTION

It is an object of the invention to provide a support for image-recording material and an image-recording material having such a support that is recordable on both surfaces with less show-through, has an excellent adhesion resistance and texture, and can record high gloss, high quality images.

A support for image-recording material according to the present invention comprises a paper, and at least one polymer-coated layer on both surfaces of the paper, wherein each polymer-coated layer on both surfaces of the paper contains titanium dioxide, and each outermost surface of the polymer-coated layers on both surfaces of the paper is a roughened surface. The support for image-recording material is recordable on both surfaces with less show-through, has an excellent adhesion resistance and texture, and can record high gloss, high quality images.

An image-recording material according to the present invention, by having a support for image-recording material of the invention, is recordable on both surfaces with less show-through, has an excellent adhesion resistance and texture, and can record high gloss, high quality images. This image-recording material that is suitable for electrophotographic material, thermosensitive material, sublimation transfer material, thermal transfer material, silver salt photographic material, inkjet-recording material, and the like can be provided.

Figure 1:
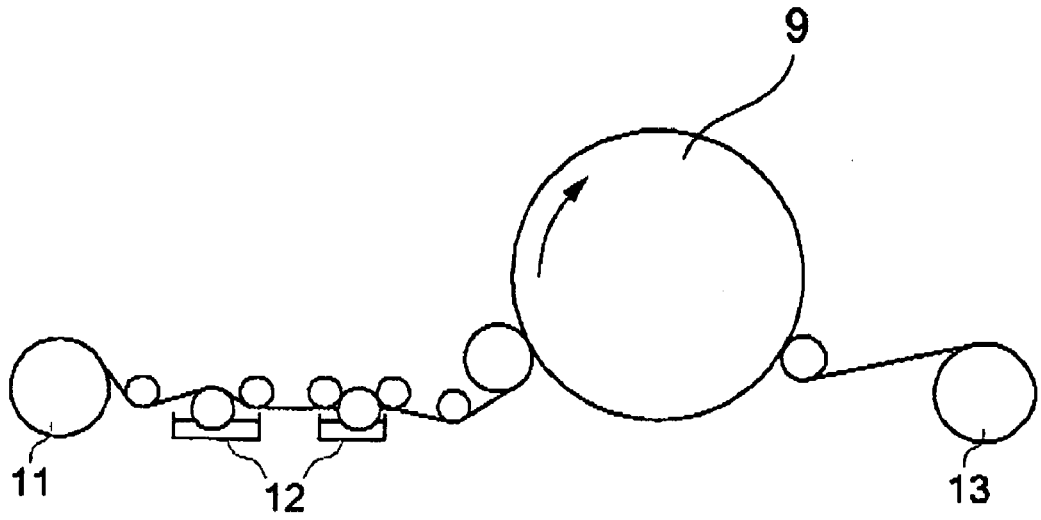
FIG. 1 is a schematic view showing an example of wet casting method of the invention.

DESCRIPTION OF THE PREFERRED EMBODIMENTS (Support for Image-recording Material)

A support for image-recording material of the invention comprises a paper, one polymer-coated layer on both surfaces of the paper and other layers where necessary.

The outermost surfaces of polymer-coated layer on both surfaces of the paper are roughened surfaces. The further details of surface roughening process and roughened surfaces are described later on.

<Paper>

The paper comprises a raw paper, a coat layer and other layers as necessary.

According to the invention, opacity of the paper is preferably 91% or more and more preferably 92% to 99% based on JIS P8238. If the opacity is less than 91%, show-through from the other surface may be more distinguishable when both surfaces are recorded.

Hunter brightness of the paper is preferably 85% or more and more preferably 90% or more. When Hunter brightness is less than 85%, quality of a recorded image may be deteriorated.

Hunter brightness can be measured, for example, by using a digital Hunter brightness meter by Toyo Seiki Seisaku-sho, Ltd.

—Raw Paper—

Raw paper is not limited and may be selected accordingly, however, high quality paper, for example, described on pages 223 to 224 of "Basic Photography Engineering—Silver Halide Photography" (Shashin kogaku no kiso ginen shashin hen) by Society of Photographic Science and Technology of Japan, published by Corona Publishing Co., Ltd. (1979) are preferred.

For raw paper, it is preferred to use pulp fibers having a fiber length distribution as disclosed, for example, in JP-A No. 5848037 (for example, sum of 24-mesh screen residue and 42-mesh screen residue is 20% by mass to 45% by mass and 24-mesh screen residue is 5% by mass or less) in order to give a desired center line average roughness to the surface.

Moreover, center line average roughness can be adjusted by adding heat and pressure to the surface of raw paper, using a machine calendar or super calender, or the like.

For raw paper, comprised support is not limited and may be selected accordingly. Examples include natural pulp selected from needle-leaf trees or broadleaf trees, mixture of natural and synthetic pulps, and the like.

Regarding pulps used as materials for the raw paper, considering the ability of improving all the surface smoothness, rigidity and dimensional stability (curl) to a sufficient level simultaneously in a balanced manner, broadleaf tree bleached kraft pulp (LBKP) is preferable, however, needle-leaf bleached kraft pulp (NBKP), broadleaf tree sulfite pulp (LBSP), and the like can be used.

A beater or a refiner, or the like, can be used for beating pulps.

The degree of Canadian Standard Freeness (C.S.F.) of pulps, because of the ability to control contraction of paper in the papermaking process, is preferably 200 ml C.S.F to 440 ml C.S.F. and more preferably 250 ml C.S.F to 380 ml C.S.F.

For pulps slurry (hereafter referred to as "pulp paper material") that are obtained after beating pulps, other various additives, for example, fillers, dry paper reinforcers, sizing agents, wet paper reinforcers, fixing agents, pH regulators and others are added accordingly.

Examples of fillers include calcium carbonate, clay, kaolin, white clay, talc, titanium oxide, diatomaceous earth, barium sulfate, aluminum hydroxide, magnesium hydroxide, and the like.

Examples of dry paper reinforcers include cationic starch, cationic polyacrylamide, anionic polyacrylamide, amphoteric polyacrylamide, carboxy-modified polyvinyl alcohol, and the like.

Examples of sizing agents include higher fatty acid salt; rosin derivatives such as rosin, maleic rosin and the like; paraffin wax, alkyl ketene dimer, alkenyl succinic anhydride (ASA); compounds containing higher fatty acid such as epoxy fatty acid amide, and the like.

Examples of wet paper reinforcers include polyamine polyamide epichlorohydrin, melamine resin, urea resin, epoxy polyamide resin, and the like.

Examples of fixing agents include polyfunctional metal salts such as aluminum sulfate, aluminum chloride, and the like; cationic polymers such as cationic starch, and the like.

Examples of pH regulators include caustic soda, sodium carbonate, and the like.

Examples of other agents include defoaming agents, dyes, slime control agents, fluorescent whitening agents, and the like.

Furthermore, softeners can be added accordingly. Softeners that are disclosed on pp. 554-555 of "Paper and Paper Process Manual" Shiyaku Time Co., Ltd. (1980), and the like can be used, for example.

These additives can be used alone or in combination of two or more. The amount added to pulp paper material is not limited and may be adjusted accordingly. Normally 0.1% by mass to 1.0% by mass is preferred.

For the pulp slurry, after adding various additives, and the like, to the pulp paper material, a papermaking process may be performed by using papermaking machines such as hand papermaking machine, fourdrinier, cylinder paper machine, twin wire machine, combination machine, and the like and raw paper is produced after drying. Furthermore, surface sizing process can be performed either before or after the drying process as desired.

Process liquids used for surface sizing is not limited and may be selected accordingly. They may contain, for example, water-soluble polymer compounds, waterproof materials, pigments, dyes, fluorescent whitening agents, and the like.

Examples of water-soluble polymer compounds include cationic starch, oxidized starch, polyvinyl alcohol, carboxy-modified polyvinyl alcohol, carboxymethylcellulose, hydroxyethylcellulose, cellulose sulfite, gelatin, casein, sodium polyacrylate, styrene-maleic anhydride copolymer sodium salt, sodium polystyrene sulfonate, and the like.

Examples of waterproof materials include latex emulsions such as styrene-butadiene copolymer, ethylene-vinyl acetate copolymer, polyethylene, vinylidene chloride copolymer, and the like; polyamide polyamine epichlorohydrin, synthetic wax, and the like.

Examples of pigments include calcium carbonate, clay, kaolin, talc, barium sulfate, titanium oxide, and the like.

To improve rigidity and dimensional stability (curl) of the raw paper, it is preferred that the ratio (Ea/Eb) of the longitudinal Young's modulus (Ea) and the lateral Young's modulus (Eb) is within the range of 1.5 to 2.0. If the ratio (Ea/Eb) is less than 1.5 or more than 2.0, rigidity or curl of electrophotographic image-receiving sheet tend to deteriorate, and may pose a problem for conveying performance.

It has been found that, in general, a "stiffness" of the paper varies according to the differences in the way paper is beaten and the elasticity (modulus) of the paper in a papermaking process after beating can be used as an important indication of the "stiffness" of the paper. The elastic modulus of the paper can be calculated from the following equation by using the relation between density and dynamic modulus which shows physical properties of viscoelastic object and measuring the velocity of sound propagation in the paper using an ultrasonic oscillator, $$E=\rho c^2(1-n^2)$$

where "E" represents dynamic modulus; "ρ" represents density; "c" represents velocity of sound in the paper; and "n" represents Poisson's ratio.

In case of an ordinary paper, n=0.2 or so and the difference is small enough to make the following equation effective:

$$E=\rho c^2$$

Accordingly, if a density of the paper and acoustic velocity can be measured, the elastic modulus can easily be calculated. In the above equation, when measuring acoustic velocity, various instruments commonly known may be used, such as Sonic Tester SST-110 (Nomura Shoji Co., Ltd.), or the like.

The thickness of raw paper is not limited and may be adjusted accordingly. It is preferably 30 μm to 500 μm and more preferably 50 μm to 300 μm, and still more preferably 100 μm to 250 μm. The basis mass of raw paper is not limited and may be selected accordingly. For example, it is preferably from 50 g/m$^2$ to 250 g/m$^2$, and more preferably from 100 g/m$^2$ to 200 g/m$^2$.

Calender process is preferably performed on the raw paper. It is preferably performed in the manner that the image-recording surface of the paper would come in contact with the metal roller as it passes through the apparatus. The surface temperature of the metal roller is preferably 100° C. or more, more preferably 150° C. or more, and much more preferably 200° C. or more. There is no upper limit for the surface temperature and it can be adjusted accordingly, however, it is preferably approximately 300° C., for example.

The nip pressure for calender process is not limited and may be adjusted accordingly. It is preferably 100 kN/cm$^2$ or more, and more preferably 100 kN/cm$^2$ to 600 kN/cm$^2$.

The calender used in the calender process is not limited and may be selected accordingly. It may contain, for example, soft calender rollers having a combination of metal roller and synthetic resin roller, or machine calender rollers having a pair of metal rollers. Of all others, the calender containing soft calender rollers is preferable because shoe calender with a long nip containing a metal roller and a shoe roller via synthetic resin belt is able to have a long nip width increasing the contact area between coat layer of the raw paper and rollers.

—Coat Layers—

Coat layer is preferably formed on at least one surface of the raw paper containing pigments, adhesives and other components as necessary. In this case, coat layer can be formed on either one surface or both surfaces of the raw paper and can be single or multiple layers.

Coat layer is not limited and may be selected accordingly, for example, it is preferably cast coat layer.

Pigments are not limited and may be selected accordingly. Examples of pigments include silica, alumina, calcium carbonate, magnesium carbonate, barium sulfate, aluminum hydroxide, kaolin, talc, day, titanium dioxide, zinc oxide, various plastic pigments, and the like. These may be used alone or in combination of two or more.

Adhesives are not limited and may be selected accordingly. Examples of adhesives include starches such as oxidized starch, esterification starch, and the like; cellulose derivatives such as carboxymethylcellulose, hydroxyethylcellulose, and the like; proteins such as gelatin, casein, soy protein and the like; polyvinyl alcohol, polyvinyl pyrrolidone, acrylate resin, styrene-acrylate resin, vinyl acetate resin, vinyl chloride resin, urea resin, urethane resin, alkyd resin, polyester resin, polycarbonate resin, styrene-butadienelatex or derivatives of these. These may be used alone or in combination of two or more.

When several kinds of adhesives are used, coating liquids for coat layers may be varied according to their property, prescription and use.

The amount of adhesives contained relative to the total amount of coat layer by solid state conversion is preferably 1% by mass to 10% by mass and more preferably 3% by mass to 8% by mass.

The combination ratio of pigments and adhesives (P/B ratio=number of dry composition mass of pigments/number of dry composition mass of adhesives) is not specified and may be adjusted accordingly. It is preferably 1.5 to 15 and more preferably 3 to 7. If combination ratio is great, smoothness may be deteriorated.

For the coat layer, known agents such as water-repellent agent, water resistant agent, pigment dispersant, water retention agent, viscosity improver, defoaming agent, antiseptics, colorant, lubricant agent, plasticizer, fluorescence dye, ultraviolet absorber, antioxidant, cation polymer electrolyte, and the like may be added as necessary except for pigments and adhesives.

The coat layers can be formed by applying coating liquids for coat layers that containing above-mentioned elements to at least one surface of the raw paper.

For example, blade coater, air knife coater, roll coater, comma coater, brush coater, squeeze coater, curtain coater, kiss coater, bar coater, gravure coater, and the like are used for applying coating liquids for coat layers.

The amount of coating liquids for coat layer being applied, by solid state conversion, is preferably 2 g/m$^2$ to 50 g/m$^2$ and more preferably 3 g/m$^2$ to 30 g/m$^2$. The thickness of coat layer is not specified and may be adjusted accordingly and it is preferably 1 μm to 45 μm.

The methods for drying coat layers include, for example, air floating dryer, infrared radiation dryer, cylinder dryer, and the like.

A surface process is preferably performed on the coat layers using members having a smooth surface. For example, it can be performed by allowing members having a smooth surface to touch the coat layer thereby transferring the surface property. Members having a smooth surface are preferably a metal drum having a smooth mirror-finished surface, for example.

The method for transferring a surface property of members having a smooth surface to the coat layer is not limited and may be selected accordingly. It is preferably cast coating method, for example. It is performed by applying coating liquids for cast coating to the raw paper and attaching the cast-coated layer to the heated finished surface of the metal cast drum by pressure when all or the surface of cast-coated layer are in the state of lubricated or plasticized condition, transferring a finished surface simultaneously while cast-coat layer is being dried.

The method for cast coating is not limited and may be selected accordingly. Examples include wet casting method, gelatinization casting method and rewet casting method. These methods share the same procedure in obtaining a high-gloss cast-coated layer surface by transferring a surface property of mirror-finished cast drums. However, they differ in the process by which applied coating liquids for cast coating are attached to the cast drums by pressure as described below.

In the wet casting method (direct technique), coating liquid for cast coating is applied to the raw paper and attached to the mirror-finished cast drum 9 by pressure without drying and the surface property is transferred. Unwind-portion 11, coater 12 and wind-up portion 13 of the wet casting method are shown in FIG. 1.

In the gelatinization casting method, coating liquid for cast coating is applied to the raw paper and treated with a congealed liquid to make a gelatinization condition with no flowability. Then it is attached to the mirror-finished cast drum 9 by pressure and the surface property is transferred.

Figure 2:
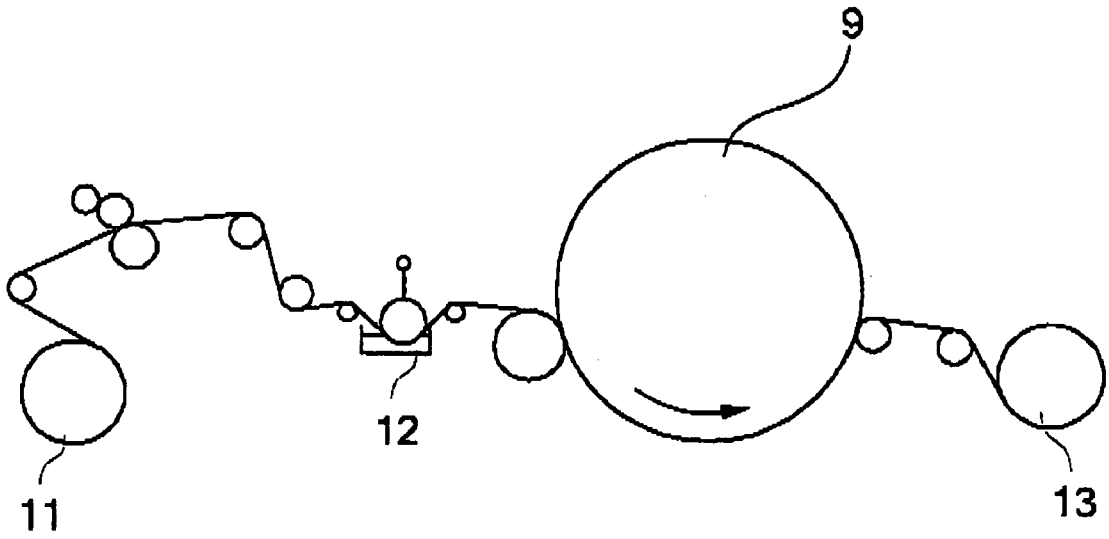
FIG. 2 is a schematic view showing an example of gelatinization casting method of the invention.

Unwind-portion 11, coater 12 and wind-up portion 13 of the gelatinization casting method are shown in FIG. 2.

Figure 3:
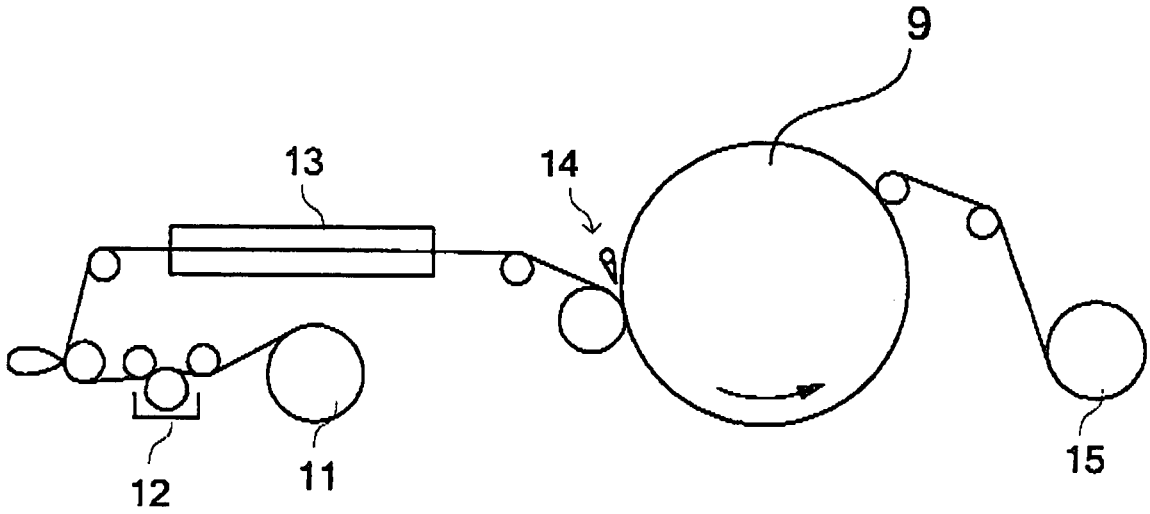
FIG. 3 is a schematic view showing an example of rewet casting method of the invention.

In the rewet casting method, after coating liquid is applied on the raw paper and dried in advance, a re-lubricant consisting mainly water is applied to the dried coat layer surface making a lubricated and plasticized condition. Then the surface is dried by being attached to the mirror-finished cast drum 9 by pressure, resulting in a smooth and high-gloss cast-coated paper. This rewet casting method has high productivity compared to wet casting or gelatinization casting method. Unwind-portion 11, coater 12, dryer 13, rewet liquid coating portion 14 and wind-up portion 15 of the rewet casting method are shown in FIG. 3.

For any of these methods: wet casting method, gelatinization casting method or rewet casting method, a cast drum is a mirror-finished metal drum having a circular cylindrical outer surface and used in a heated condition at a temperature of 80° C. to 150° C. normally.

When applying cast-coated layers by rewet method, examples for rewet liquids include phosphorus compounds: ammonium salt, polyamide resin, hexametaphosphoric acid, and the like; amide compound, fluoride, zinc sulfate, formic acid calcium, and the like.

When applying cast-coated layers by coagulation method, examples for coagulating agents that can be added to congealed liquids include salt, borax and various borate salt consisting of formic acid, acetic acid, citric add, tartaric acid, lactic acid, hydrochloric acid, sulfuric acid, carbonic acid, and the like, calcium, zinc, magnesium, natrium, kalium, barium, lead, cadmium, ammonium, and the like. These can be used alone or in combination of two or more.

<Polymer-coated Layer>

At least one or preferably two or more polymer-coated layers are applied to the both surfaces of the paper.

The polymer-coated layers on both surfaces of the paper contain titanium dioxide.

When each surface of the paper has one polymer-coated layer (single layer), the content of titanium dioxide in the polymer-coated layer is preferably 5% by mass to 20% by mass. The thickness of the polymer-coated layer is preferably 10 μm to 50 μm.

When each surface of the paper has two or more polymer-coated layers (multi layers), the content of titanium dioxide in the site of the layer furthermost from the paper is preferably greater than the content of titanium dioxide in the site of the layer adjacent to the paper.

The content of titanium dioxide in the site of the polymer-coated layer furthermost from the paper is preferably 10% by mass to 20% by mass. The content of titanium dioxide in the site of the polymer-coated layer adjacent to the paper is preferably 10% by mass or less and more preferably 0% by mass to 10% by mass.

In this case, the thickness of the site of the polymer-coated layer adjacent to the paper is preferably 5 μm to 25 μm The thickness of the site of the polymer-coated layer furthermost from the paper is preferably 5 μm to 15 μm When each surface of the paper have three layers of polymer-coated layer in the order of bottom polymer-coated layer, intermediate polymer-coated layer and top polymer-coated layer, the site of the polymer-coated layer adjacent to the paper becomes bottom polymer-coated layer and the site of the polymer-coated layer furthermost from the paper becomes top polymer-coated layer.

In this case, the thickness of bottom polymer-coated layer is preferably 5 μm to 20 μm. The thickness of intermediate polymer-coated layer is preferably 5 μm to 20 μm. The thickness of top polymer-coated layer is preferably 5 μm to 10 μm.

Each outermost surface of polymer-coated layers on both surfaces has a roughened surface.

It is preferably the one selected from matte surface, semi matte surface, minute matte surface, embossed surface, flustered surface and combination thereof. The roughened surfaces of front and back surface of paper can be different.

These matte surface, semi matte surface and minute matte surface can be obtained by pressing a member (roller or belt or the like, for example) which has been treated in surface roughening process (matte process) to each of outermost surfaces of polymer-coated layers. Examples of methods for giving matte process include sandblast, hot rolling and plasma ion process, and the like.

The embossed surfaces can be obtained by the emboss process. It is performed by hot rolling with an emboss roller that has been etched or engraved with a rough pattern.

The surface gloss of at least one surface of the roughened surface is preferably 5% to 65% and more preferably 5% to 45% according to JIS P8142. If the surface gloss is less than 5% and rolled up as a roller, surface of the reverse surface may become delicate. If it is more than 65%, an attachment failure with the reverse surface may be more likely to occur.

Polymer that makes up the polymer-coated layer is preferably a resin having film-forming ability. Of all others, it is preferably polyolefin resin. Examples of polyolefin resin include polyethylene, polypropylene, a mixture of polypropylene and polyethylene, high density polyethylene, a mixture of high and low density polyethylene, and the like.

Methods for forming polymer-coated layers are not limited and may be selected accordingly. Examples of such methods include ordinary lamination, sequential lamination, or lamination methods using single layer or multilayer extrusion die or laminators such as heat blocking type, multi-manifold type, multi-slot type, or the like. Configuration of single or multiple extrusion die is not limited and may be selected accordingly. It is preferably T die or coat hunger die, or the like.

The support for image-recording material of the invention as described above, is recordable on both surfaces with less show-through, has an excellent adhesion resistance and texture and can record high gloss, high quality images. This can be used for various purposes, for example, electrophotographic material, thermosensitive material, sublimation transfer material, thermal transfer material, silver salt photographic material, inkjet recording material, and the like.

—Image-recording Material—

The image-recording material of the invention comprises a support for image-recording material and at least one image-recording layer on the support and other layers as necessary.

For the support for image-recording material, it is as described above.

The image-recording material varies according to the purpose and type, and examples include electrophotographic material, thermosensitive material, sublimation transfer material, thermal transfer material, silver salt photographic material, inkjet-recording material, and the like. The description of each image-recording material is given below.

<Electrophotographic Material>

The electrophotographic material comprises a support for an image-recording material of the invention and toner image-receiving layers disposed on at least one surface or preferably both surfaces of the support as image-recording layers. It may also comprise other layers as necessary, for example, surface protective layers, backing layers, intermediate layers, undercoat layers, cushion layers, antistatic layers, reflection layers, color tone adjusting layers, storage property improving layers, antistick layers, anti-curl layers, smoothing layers, and the like. Each layer may be a single layer structure or a lamination layer structure.

[Toner Image-receiving Layer]

A toner image-receiving layer is a layer that receives color or black toner to form an image. The toner image-receiving layer receives toner for an image formation from a development drum or an intermediate transfer body by (static) electricity or pressure in the transferring process. It is then stabilized by heat and/or pressure, and the like, in the image fixing process.

To make an electrophotographic material of the invention more like photography, the toner image-receiving layer must be of low transparency having light transmittance of 78% or less. The light transmittance is preferably 73% or less, and more preferably 72% or less.

The light transmittance can be measured by forming a coated layer of same thickness on the polyethylene terephthalate film (100 μm) and using a direct-reading haze meter, HGM-2DP by Suga Test Instruments Co., Ltd.

The toner image-receiving layer contains at least a thermoplastic resin and other various additives, for example, releasing agent, plasticizer, coloring agent, filler, cross-linking agent, antistatic agent, emulsifying agent, dispersant, and the like, for improving thermodynamic properties of toner image-receiving layer.

—Thermoplastic Resin—

Thermoplastic resins are not limited and may be selected accordingly.

Examples include (1) polyolefin resins, (2) polystyrene resins, (3) acrylic resins, (4) polyvinyl acetates and derivatives thereof, (5) polyamide resins, (6) polyester resins, (7) polycarbonate resins, (8) polyether resins or acetal resins, and (9) other resins. Each resin can be used alone or in the combination of two or more. Of all others, styrenic resins, acrylic resins and polyester resins are preferred because they have large cohesive energy, advantageous to toner embedding.

Examples of polyolefin resins (1) are polyolefin resins such as polyethylenes, polypropylenes; and copolymers of olefin such as ethylene, propylene, or the like with vinyl monomer. Examples of such copolymers are ethylene-vinyl acetate copolymers and ionomer resins including ethylene-methacrylic acid copolymers and ethylene-methacrylic add copolymers. Examples of derivatives of polyolefin resins are chlorinated polyethylenes and chlorosulfonated polyethylenes.

Examples of polystyrene resins (2) are polystyrenes, styrene-isobutylene copolymers, acrylonitile-styrene copolymers (AS resins), acrylonitrile-butadiene-styrene copolymers (ABS resins), and polystyrene-maleic anhydride copolymers.

Examples of acrylic resins (3) are polyacrylic acids and esters thereof, polymethacrylic acids and esters thereof, polyacrylonitriles and polyacrylamides.

The esters of poly acrylic acids include, for example, homopolymers or multi-component copolymers of acrylic esters. Examples of acrylic esters are methyl acrylate, ethyl acrylate, n-butyl acrylate, isobutyl acrylate, dodecyl acrylate, n-octyl acrylate, 2-ethylhexyl acrylate, 2-chloroethyl acrylate, phenyl acrylate, and methyl α-chloroacrylate.

The esters of polymethacrylic acids include, for example, homopolymers and multi-component copolymers of methacrylic esters. Examples of methacrylic esters are methyl methacrylate, ethyl methacrylate and butyl methacrylate.

Examples of polyvinyl acetates and derivatives thereof (4) are polyvinyl acetates, polyvinyl alcohols prepared by saponifying polyvinyl acetates, and polyvinylacetal resins prepared by reacting a polyvinyl alcohol with an aldehyde such as formaldehyde, acetaldehyde or butyraldehyde.

The polyamide resins (5) are polycondensates of a diamine with a dibasic acid, such as 6-nylon and 6,6-nylon.

The polyester resins (6) are prepared by polycondensation of an acid component and an alcohol component. The acid component can be any suitable one, and examples thereof are maleic acid, fumaric acid, citraconic acid, itaconic acid, glutaconic acid, phthalic acid, terephthalic acid, isophthalic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, n-octylsuccinic acid, isooctenylsuccinic acid, isooctylsuccinic add, trimellitic acid, pyromellitic acid, anhydrides or lower alkyl esters of these acids.

The alcohol component is not limited and may be selected accordingly.

For example, it is preferably dihydric alcohols. Examples of aliphatic diols are ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol. Examples of alkylene oxide adducts of bisphenol A are polyoxypropylene, (2.2)-2,2-bis(4-hydroxyphenyl)propane, polyoxypropylene (3.3)-2,2-bis(4-hydroxyphenyl)propane, polyoxyethylene (2.0)-2,2-bis(4-hydroxyphenyl)propane, polyoxypropylene (2.0)-polyoxyethylene (2.0)-2,2-bis(4-hydroxyphenyl)propane, and polyoxypropylene (6)-2,2-bis(4-hydroxyphenyl)propane.

Examples of polycarbonate resins (7) are polycarbonates derived from bisphenol A and phosgene.

Examples of polyether resins or acetal resins (8) are polyether resins such as polyethylene oxides and polypropylene oxides; and acetal resins such as polyoxymethylenes prepared as a result of ring-opening polymerization.

Other resins (9) include, for example, polyurethane resins prepared as a result of polyaddition.

A thermoplastic resin is preferably the one that can satisfy the requirements of physical properties of an after-mentioned toner image-receiving layer when being formed as a layer. It is more preferably the one that can satisfy such requirements by itself. It is also preferred that two or more resins exhibiting different physical properties of the after-mentioned toner image-receiving layer are used in combination.

A thermoplastic resin preferably has a molecular mass larger than that of a thermoplastic resin used in the toner. However, this relationship in molecular mass between two thermoplastic resins may not apply to some cases. For example, when the thermoplastic resin used in the toner image-receiving layer has a softening point higher than that of the thermoplastic resin used in the toner, the former thermoplastic resin may preferably have a molecular mass equivalent to or lower than that of the latter thermoplastic resin.

A mixture of resins having the same composition but different average molecular mass is also preferably used as the thermoplastic resin in the toner image-receiving layer. The relationship in molecular mass between the thermoplastic resin used in the toner image-receiving layer and the one used in the toner is preferably the one disclosed in JP-A No. 08-334915.

The thermoplastic resin for toner image-receiving layer is preferably the one having particle size distribution larger than that of thermoplastic resin used in the toner.

The thermoplastic resin for the toner image-receiving layer is preferably the one that satisfies the requirements of physical properties as disclosed in, for example, JP-A Nos. 05-127413, 08-194394, 08-334915, 34916, 09-171265, and 10-221877.

For the thermoplastic resins for toner image-receiving layer, aqueous resins such as water-dispersible polymers and water-soluble polymers are preferred for the following reasons.

(i) These aqueous resins do not invite exhaustion of an organic solvent in a coating and drying process and are thereby environment friendly and have a good workability.

(ii) Most of waxes and other releasing agents are difficult to dissolve in solvents at a room temperature and are often dispersed in a medium (water or an organic solvent) before use. Such aqueous dispersions are more stable and suitable for production processes. When an aqueous composition containing thermoplastic resin and a wax is applied, the wax readily bleeds out on the surface of a coated layer in the coating and drying process, thus yielding the effects of the releasing agent (anti-offset properties and adhesion resistance, etc.) more satisfactorily.

The aqueous resin for use herein may be any water-dispersible or water-soluble polymers and may have any composition, bonding structure, molecular structure, molecular mass and distribution thereof, and configuration. Examples of aqueous polymer groups are sulfo group, hydroxy group, carboxy group, amino group, amido group, and ether group.

The water-dispersible polymer can be selected from water-dispersed resins, emulsions, copolymers, mixtures and cationic modified products thereof of the thermoplastic resins (1) to (9). Each of these polymers can be used alone or in combination.

The water-dispersible polymer can be suitably prepared or is available as commercial products. For example, water-dispersible polyester-based polymers are commercially available as the Vylonal Series by Toyobo Co., Ltd, the Pesresin A Series by Takamatsu Oil & Fat Co., Ltd., the Tuftone UE Series by Kao Corporation, the polysterWR Series by Nippon Synthetic Chemical Industry Co., Ltd., and the Elitel Series by Unitika Ltd. Water-dispersible acrylic polymers are commercially available as the Hiros XE, KE and PE series by Seiko Chemical Industries Co., Ltd., and the Jurymer ET series by Nihon Junyaku Co., Ltd.

The water-dispersible emulsion is not specifically limited and can be selected accordingly. Examples of such emulsions are water-dispersible polyurethane emulsions, water-dispersible polyester emulsions, chloroprene emulsions, styrene-butadiene emulsions, nitrile-butadiene emulsions, butadiene emulsions, vinyl chloride emulsions, vinylpyridine-styrene-butadiene emulsions, polybutene emulsions, polyethylene emulsions, vinyl acetate emulsions, ethylene-vinyl acetate emulsions, vinylidene chloride emulsions, and methyl methacrylate-butadiene emulsions. Among them, water-dispersible polyester emulsions are preferred.

The water-dispersible polyester emulsions are preferably self-dispersible aqueous polyester emulsions, of which self-dispersible aqueous carboxyl-containing polyester emulsions are typically preferred. The "self-dispersible aqueous polyester emulsion" herein means an aqueous emulsion containing polyester resin that is self-dispersible in an aqueous solvent without use of an emulsifier. The "self-dispersible aqueous carboxyl-containing polyester emulsion" means an aqueous emulsion containing a polyester resin that contains carboxyl groups as hydrophilic groups and is self-dispersible in an aqueous solvent.

The self-dispersible aqueous polyester emulsion preferably satisfies the following requirements (1) to (4). This type of polyester resin emulsion is self-dispersible requiring no surfactant, has low moisture absorbency even in a high humid condition, causes less lowering of its softening point due to the moisture and can thereby avoid occurrence of offset during image fixation and adhesion failures between sheets during storage. The emulsion is water-based and is environmentally friendly and excellent in workability. In addition, the polyester resin used herein readily takes a molecular structure containing high cohesive energy. Accordingly, the resin sustains sufficient rigidity during storage but can be melted with low elasticity and low viscosity during image fixation process of electrophotography, and the toner is filled into the toner image-receiving layer for image formation having sufficiently-high quality.

(1) The number-average molecular mass Mn is preferably 5,000 to 10,000 and more preferably 5,000 to 7,000.

(2) The molecular mass distribution (Mw/Mn) is preferably 4 or less, and more preferably 3 or less, wherein Mw stands for mass-average molecular mass.

(3) The glass transition temperature Tg is preferably 40° C. to 100° C. and more preferably 50° C. to 80° C.

(4) The volume average particle diameter is preferably from 20 nm to 200 nm and more preferably from 40 nm to 150 nm.

The content of water-dispersible emulsion in the toner image-receiving layer is preferably 10% by mass to 90% by mass, and more preferably 10% by mass to 70% by mass.

The water-soluble polymer can be any suitable one preferably having a mass-average molecular mass (Mw) of 400,000 or less and can be suitably prepared or is commercially available as products. Examples of such water-soluble polymers are polyvinyl alcohols, carboxy-modified polyvinyl alcohols, carboxymethylcellulose, hydroxyethylcellulose, cellulose sulfate, polyethylene oxides, gelatin, cationized starch, casein, polysodium acrylates, sodium styrene-maleic anhydride copolymers, and sodium polystyrene sulfonate, of which polyethylene oxides are preferred.

The water-soluble polymers are commercially available as, for example, various Pluscoats by Goo Chemical Co., Ltd. and the Finetex ES series by Dainippon Ink & Chemicals Inc. Examples of water-soluble acrylics are the Jurymer AT series by Nihon Junyaku Co., Ltd., Finetex 6161 and K-96 by Dainippon Ink & Chemicals Inc., and Hiros NL-1189 and BH-997L by Seiko Chemical Industries Co., Ltd.

Typical disclosure of the water-soluble polymers can be found in, for example, Research Disclosure No. 17,643, pp. 26; Research Disclosure No. 18,716, pp. 651; Research Disclosure No. 307,105, pp. 873-874; and JP-A No. 64-13546.

The content of water-soluble polymer in the toner image-receiving layer is not limited and may be adjusted accordingly and it is preferably 0.5 g/m$^2$ to 2 g/m$^2$.

The thermoplastic resin can be used simultaneously with other polymer materials. When used in such a manner, generally, the amount of thermoplastic resin contained in the layer should be greater than that of other polymers.

The content of thermoplastic resin in the toner image-receiving layer is preferably 10% by mass or more, more preferably 30% by mass or more, much more preferably 50% by mass or more, and most preferable to be 50% by mass to 90% by mass.

—Releasing Agent—

The releasing agent is incorporated into the toner image-receiving layer so as to prevent offset of toner image-receiving layer. Such releasing agents that are used in the invention are not specifically limited and can be appropriately selected, as long as they are melted or fused by heating at an image-fixing temperature, are deposited on the surface of toner image-receiving layer forming a layer of releasing agent on the surface by cooling and solidifying.

The releasing agent may be the one selected from silicone compounds, fluorine compounds, waxes, and matting agents.

As releasing agents, the compounds mentioned for example in "Properties and Applications of Waxes, Revised Edition", published by Saiwai Shobo, or "The Silicon Handbook" published by THE NIKKAN KOGYO SHIMBUN, may be used. Further, the silicon compounds, fluorine compounds or waxes used for the toners mentioned in Japanese Patent Application Publication Nos. 59-38581, 04-32380, Japanese Patents (JP-B) Nos. 2838498, 2949558, JP-A Nos. 50-117433, 52-52640, 57-148755, 61-62056, 61-62057, 61-118760, 02-42451, 03-41465, 04-212175, 04-214570, 04-263267, 05-34966, 05-119514, 06-59502, 06-161150, 06-175396, 06-219040, 06-230600, 06-295093, 07-36210, 07-43940, 07-56387, 07-56390, 07-64335, 07-199681, 07-223362, 07-287413, 08-184992, 08-227180, 08-248671, 08-248799, 08-248801, 08-278663, 09-152739, 09-160278, 09-185181, 09-319139, 09-319143, 10-20549, 10-48889, 10-198069, 10-207116, 11-2917, 11-44969, 11-65156, 11-73049 and 11-194542 can also be used. Moreover, these compounds may be used in combination of two or more.

Examples of silicone compounds include silicone oils, silicone rubber, silicone fine particles, silicone-modified resins and reactive silicone compounds.

Such silicone oils include, for example, unmodified silicone oil, amino-modified silicone oil, carboxy-modified silicone oil, carbinol-modified silicone oil, vinyl-modified silicone oil, epoxy-modified silicone oil, polyether-modified silicone oil, silanol-modified silicone oil, methacrylic-modified silicone oil, mercapto-modified silicone oil, alcohol-modified silicone oil, alkyl-modified silicone oil, and fluorine-modified silicone oil.

Examples of silicone-modified resins are silicone-modified resins derived from olefinic resins, polyester resins, vinyl resins, polyamide resins, cellulose resins, phenoxy resins, vinyl chloride-vinyl acetate resins, urethane resins, acrylic resins, styrene-acrylic resins, or copolymers comprising at least one of these constitutive monomers.

The fluorine compounds are not specifically limited and can be selected accordingly. Examples thereof are fluorocarbon oils, fluoro rubber, fluorine-modified resins, fluorosulfonic acid compounds, fluorosulfonic acid, fluoric acid compounds or salts thereof, and inorganic fluorides.

The waxes are roughly classified as naturally-occurring waxes and synthetic waxes.

Preferred examples of naturally-occurring waxes are vegetable waxes, animal waxes, mineral waxes, and petroleum waxes, of which vegetable waxes are typically preferred. As naturally-occurring waxes, water-dispersible waxes are preferred for their good compatibility (miscibility) if an aqueous resin is used as a polymer component in the toner image-receiving layer.

The vegetable waxes are not specifically limited and can be selected from known vegetable waxes such as prepared or commercially available ones. Examples of vegetable waxes are carnauba waxes, castor oil, rape oil, soybean oil, Japan tallow, cotton wax, rice wax, sugarcane wax, candelilla wax, Japan wax and jojoba oil.

Carnauba waxes are commercially available under the trade names of, for example, EMUSTAR-0413 by Nippon Seiro Co., Ltd., and SELOSOL 524 by Chukyo Yushi Co., Ltd. The caster oil is commercially available as, for example, purified caster oil by Itoh Oil Chemicals Co., Ltd.

Among them, carnauba waxes having a melting point of 70° C. to 95° C. are preferred, because they can lead to the production of an electrophotographic material that have excellent anti-offset properties, adhesion resistance and paper conveying properties, and with a good surface gloss and less cracking, can form high-quality images.

The animal waxes are not limited and may be selected from known products. Examples thereof are beeswaxes, lanolin, spermaceti waxes, whale oils, and wool waxes.

The mineral waxes are not limited and may be selected from known products. They can be, for example, properly synthesized or commercially available products. Examples thereof are montan wax, montan ester wax, ozokerite, and ceresin.

Among them, montan waxes having a melting point of 70° C. to 95° C. are preferred, because they can lead to the production of an electrophotographic material that have excellent anti-offset properties, adhesion resistance and paper conveying properties, and with a good surface gloss and less cracking, can form high-quality images.

The petroleum waxes are not limited and may be selected from known products. They can be, for example, properly synthesized or commercially available products. Examples thereof are paraffin wax, microcrystalline wax and petrolatum.

The content of naturally-occurring wax in the toner image-receiving layer is preferably 0.1 g/m$^2$ to 4 g/m$^2$, and more preferably 0.2 g/m$^2$ to 2 g/m$^2$.

If the content is less than 0.1 g/m$^2$, anti-offset properties and adhesion

If the content is less than 0.1 g/m$^2$, anti-offset properties and adhesion resistance may not be satisfactory. If it is more than 4 g/m$^2$, quality of the resulting image may be deteriorated because of excessive wax.

For sufficient anti-offset properties and paper conveying properties, the melting point (° C.) of naturally-occurring wax is preferably 70° C. to 95° C., and more preferably 75° C. to 90° C.

The synthetic waxes are classified as synthetic hydrocarbons, modified waxes, hydrogenated waxes, and other fats and oil-derived synthetic waxes. These waxes are preferably water-dispersible waxes for their good miscibility with an aqueous thermoplastic resin, if any, in the toner image-receiving layer.

Examples of synthetic hydrocarbons are Fischer-Tropsch wax and polyethylene wax.

Examples of fats and oil-derived synthetic waxes are acid amide compounds such as stearamide, and acid Imide compounds such as anhydrous phthalimide.

The modified waxes include, but are not limited to, amine-modified wax, acrylic acid-modified wax, fluorine-modified wax, olefin-modified wax, urethane-type wax, and alcohol-type wax.

The hydrogenated waxes include, but are not limited to, castor oil, castor oil derivatives, stearic acid, lauric acid, myristic acid, palmitic acid, behenic acid, sebacic acid, undecylenic add, heptylate, maleic acid, high grade maleic oils.

For sufficient anti-offset properties and paper conveying properties, the melting point of the releasing agent is preferably 70° C. to 95° C., and more preferably 75° C. to 90° C.

The releasing agents used in the toner image-receiving layer can be substances. Each of these releasing agents may have one or more reactive substituents.

The content of releasing agent in the toner image-receiving layer is preferably 0.1% by mass to 10% by mass, more preferably 0.3% by mass to 8.0% by mass, and still more preferably 0.5% by mass to 5.0% by mass based on the total mass of the toner image-receiving layer.

If the content is less than 0.1% by mass, anti-offset properties and adhesion resistance may not be satisfactory. If it is more than 10% by mass, the image quality may be deteriorated because of excessive releasing agent.

—Plasticizer—

The plasticizers can be any of known plasticizers for resins. The plasticizers work to control fluidizing or softening of the toner image-receiving layer when heat and/or pressure were applied in the toner fixation process.

Typical disclosures of plasticizers can be found in, for example, "Chemical Handbook" (Kagaku Binran) edited by The Chemical Society of Japan, Maruzen Co., Ltd. Tokyo; "Plasticizer, Theory and Application" edited and written by Koichi Mural and published by Saiwai Shobo; "Studies on Plasticizers Vol. 1 and 2" edited by Polymer Chemistry Association; and "Handbook on Compounding Ingredients for Rubbers and Plastics" edited by Rubber Digest Co.

Such plasticizers are also referred to as high-boiling organic solvents and thermal solvents in some publications. Examples of plasticizers are esters such as phthalic, phosphoric, fatty acids, abietic, adipic, sebacic, azelaic, benzoic, butyric, epoxidized fatty acids, glycolic, propionic, trimellitic, citric, sulfonic, carboxylic, succinic, maleic, fumaric, and stearic acid; amides including aliphatic amides and sulfonamides, ethers, alcohols, lactones, polyethylene oxides and compounds described in JP-A Nos. 59-83154, 59-178451, 59-178453, 59-1784, 59-178455, 59-178457, 62-174754, 62-245253, 61-209444, 61-200538, 62-8145, 62-9348, 62-30247, 62-136646, and 2-235694.

One or more of these plasticizers can be incorporated into the resin component.

Polymer plasticizers having relatively low molecular mass can also be used herein. The molecular mass of such plasticizer is preferably lower than that of binder resin being plasticized and is preferably 15,000 or less, and more preferably 5,000 or less. When these polymer plasticizers are used, they should be of the same kind with resin being plasticized. For example, low molecular-mass polyesters are preferably used for plasticizing polyester resin. In addition, oligomers can be used as a plasticizer.

In addition to aforementioned compounds, the plasticizers are also commercially available under the trade names of, for example, Adekacizer PN-170 and PN-1430 by Asahi Denka Kogyo Co., Ltd.; PARAPLEX G-25, G-30 and G-40 by C.P. Hall Co.; Ester Gum 8L-JA, Ester R-95, Pentalin 4851, FK 115, 4820 and 830, Luisol 28-JA, Picolastic A75, Picotex LC and Crystalex 3085 by Rika Hercules Co.

The plasticizers may be optionally used so as to mitigate stress and/or strain when toner particles are embedded in the toner image-receiving layer. Such strain includes, for example, physical strain such as elastic force and viscosity, and strain due to material balance in, for example, molecules, principle chains and/or pendant moieties of the binder.

The plasticizers may be finely dispersed or may undergo micro-phase separation into sea-island structure or may be sufficiently dissolved with other components such as binder in the toner image-receiving layers.

The content of plasticizer in the toner image-receiving layer is preferably 0.001% by mass to 90% by mass, more preferably 0.1% by mass to 60% by mass, and further preferably 1% by mass to 40% by mass.

The plasticizers may be used to control slipping property, thereby improving conveyance performance by reduced friction, or to improve anti-offset property during fixing (separation of toner or layers from the fixing member) or to control curling property and charging property for desirable latent toner image formation.

—Colorant—

The colorants are not limited and may be selected accordingly. Examples include fluorescent brightening agents, white pigments, colored pigments and dyes.

There is no specification for fluorescent brightening agents and various fluorescent brightening agents known may be used as long as they have absorption spectrum near ultraviolet region and are compounds emitting fluorescence at a range of 400 nm to 500 nm. The compounds described in "The Chemistry of Synthetic Dyes" Volume V, Chapter 8 edited by K VeenRataraman are the good examples. They can be properly synthesized or commercially available products and examples include stilbene compounds, coumarin compounds, biphenyl compounds, benzo-oxazoline compounds, naphthalimide compounds, pyrazoline compounds and carbostyril compounds. Examples of these are white furfar-PSN, PHR, HCS, PCS, B from Sumitomo Chemicals, and UVI-TEX-OB from Ciba-Geigy.

The white pigment is not limited and may be selected from known products accordingly. Examples are inorganic pigments such as titanium dioxide and calcium carbonate.

Examples of colored pigments include, but are not limited to, various pigments described in JP-A No. 63-44653, azo pigments, polycyclic pigments, fused polycyclic pigments, lake pigments and carbon black.

Examples of azo pigments are azo lakes such as carmine 6B and red 2B; insoluble azo pigments such as monoazo yellow, disazo yellow, pyrazolone orange, and Vulcan orange; and condensed azo compounds such as chromophthal yellow and chromophthal red.

Examples of polycyclic pigments are phthalocyanine pigments such as copper phthalocyanine blue and copper phthalocyanine green.

Examples of condensed polycyclic pigments are dioxazine pigments such as dioxazine violet; isoindolinone pigments such as isoindolinone yellow; threne pigments; perylene pigments; perinone pigments; and thioindigo pigments.

Examples of lake pigments are malachite green, rhodamine B, rhodamine G, and Victoria blue B.

Examples of inorganic pigments are oxides such as titanium dioxide and colcothar; sulfates such as precipitated barium sulfate; carbonates such as precipitated calcium carbonate; silicates such as hydrous silicates and anhydrous silicates; and metal powders such as aluminum powder, bronze powder, zinc powder, chrome yellow and iron blue.

Each of these can be used alone or in combination of two or more.

The dye is not limited and may be selected from known products accordingly. Examples include anthraquinone compounds and azo compounds.

Each of these can be used alone or in combination of two or more. Examples of water-insoluble dyes are vat dyes, disperse dyes and oil-soluble dyes. The vat dyes include, but are not limited to, C.I. Vat violet 1, C.I. Vat violet 2, C.I. Vat violet 9, C.I. Vat violet 13, C.I. Vat violet 21, C.I. Vat blue 1, C.I. Vat blue 3, C.I. Vat blue 4, C.I. Vat blue 6, C.I. Vat blue 14, C.I. Vat blue 20 and C.I. Vat blue 35. The disperse dyes include, but are not limited to, C.I. disperse violet 1, C.I. disperse violet 4, C.I. disperse violet 10, C.I. disperse blue 3, C.I. disperse blue 7 and C.I. disperse blue 58. The oil-soluble dyes include, but are not limited to, C. I. solvent violet 13, C.I. solvent violet 14, C.I. solvent violet 21, C.I. solvent violet 27, C.I. solvent blue 11, C.I. solvent blue 12, C.I. solvent blue 25 and C.I. solvent blue 55.

Colored couplers used in silver salt photography are also suitable.

The amount ($g/m^2$) of coloring agent in the above toner image-receiving layer is preferably from 0.1 $g/m^2$ to 8 $g/m^2$ and more preferably from 0.5 $g/m^2$ to 5 $g/m^2$.

If the amount of coloring agent is less than 0.1 $g/m^2$, light transmittance in the toner image-receiving layer may become high, and if it is more than 8 $g/m^2$, handling performance such as cracks and adhesion resistance may be deteriorated.

Specifically among these coloring agents, the content of pigments is preferably 40% by mass or less and more preferably 30% by mass or less and still more preferably 20% by mass or less according to the mass amount of thermoplastic resin making up the toner image-receiving layer.

The filler may be organic or inorganic filler, and reinforcers for binder resins, bulking agents and reinforcements known in the art may be used. This filler may be selected by referring to "Handbook of Rubber and Plastics Additives" edited by Rubber Digest Co., "Plastics Blending Agents—Basics and Applications" (New Edition) edited by Taisei Co. and "The Filler Handbook" edited by Taisei Co.

Various inorganic fillers or inorganic pigments can be used as filler. Examples of inorganic fillers or inorganic pigments are silica, alumina, titanium dioxide, zinc oxide, zirconium oxide, micaceous iron oxide, white lead, lead oxide, cobalt oxide, strontium chromate, molybdenum pigments, smectite, magnesium oxide, calcium oxide, calcium carbonate and mullite. Silica and alumina are particularly preferred. Fillers may be used alone, or in combination of two or more. It is preferred that the filler is having small particle diameter. If the particle diameter is large, the surface of the toner image-receiving layer tends to become rough.

Silica includes spherical silica and amorphous silica. The silica may be synthesized by dry method, wet method or aerogel method. The surface of hydrophobic silica particles may also be treated by trimethylsilyl groups or silicone. Colloidal silica is preferred. The silica is preferably porous.

Alumina includes anhydrous alumina and hydrated alumina. Examples of crystallized anhydrous alumina which may be used are α-type, β-type, γ-type, δ-type, ξ-type, η-type, θ-type, κ-type, ρ-type or χ-type. Hydrated alumina is preferred to anhydrous alumina. The hydrated alumina may be monohydrate or trihydrate. Monohydrates include pseudo-boehmite, boehmite and diaspore. Trihydrates include gypsite and bayerite. Porous alumina is preferred.

The alumina hydrate can be synthesized by the sol-gel method wherein ammonia is added to an aluminum salt solution to precipitate alumina, or by hydrolysis of an alkali aluminate. Anhydrous alumina can be obtained by dehydrating alumina hydrate by heat.

The amount of filler is preferably from 5 parts by mass to 2,000 parts by mass relative to 100 parts by mass of the dry mass of the binder in the toner image-receiving layer.

A crosslinking agent can be added in order to adjust the storage stability or thermoplastic properties of toner image-receiving layer. Examples of crosslinking agents are compounds containing two or more reactive groups in the molecule such as epoxy, isocyanate, aldehyde, active halogen, active methylene, acetylene and other reactive groups known.

The crosslinking agents also include a compound having two or more groups that are able to form bonds such as hydrogen bonds, ionic bonds or coordination bonds.

The crosslinking agent may also include known compounds used as resin coupling agent, curing agent, polymerizing agent, polymerization promoter, coagulant, film-forming agent or film-forming assistant. Examples of coupling agents are chlorosilanes, vinylsilanes, epoxisilanes, aminosilanes, alkoxyaluminum chelates, titanate coupling agents or other agents known such as those mentioned in "Handbook of Rubber and Plastics Additives" edited by Rubber Digest Co.

The toner image-receiving layer preferably comprises a charge control agent for controlling transfer and adhesion of the toner or preventing static adhesion of the toner image-receiving layer. The charge control agent is not limited and may be selected from known various charge control agents accordingly. Examples include cationic surfactants, anionic surfactants, amphoteric surfactants, non-ionic surfactants, and polymer electrolytes or electroconducting metal oxides. Examples of surfactants are cationic charge inhibitors such as quarternary ammonium salts, polyamine derivatives, cation-modified polymethylmethacrylate, cation-modified polystyrene, anionic charge inhibitors such as alkyl phosphates and anionic polymers, or non-onic charge inhibitors such as fatty acid esters and polyethylene oxide.

When toner is negatively charged, the charge control agent in the toner image-receiving layer is preferably the one cationic or nonionic.

Examples of electroconducting metal oxides are ZnO, $TiO_2$, $SnO_2$, $Al_2O_3$, $In_2O_3$, $SiO_2$, MgO, BaO and $MoO_3$. These electroconducting metal oxides may be used alone, or in the form of complex oxide. The electroconducting metal oxide may also contain other elements (doping), for example, ZnO may contain Al or In, $TiO_2$ may contain Nb or Ta, and $SnO_2$ may contain Sb, Nb or halogen elements (doping).

—Other Additives—

Materials that can be used for toner image-receiving layer of the invention may also contain various additives to improve stability of the output image or the toner image-receiving layer itself. Examples of additives are known antioxidants, age resistors, degradation inhibitors, anti-ozone degradation inhibitors, ultraviolet light absorbers, metal complexes, light stabilizers, preservatives or fungicides.

The antioxidants are not limited and may be selected accordingly. Examples include chroman compounds, coumarane compounds, phenol compounds e.g., hindered phenols, hydroquinone derivatives, hindered amine derivatives and spiroindan compounds. These antioxidants can be found in JP-A No. 61-159644.

The age resistors are not limited and may be selected accordingly. Examples are found in "Handbook of Rubber and Plastics Additives", Second Edition by Rubber Digest Co. (1993), p 76-121.

The ultraviolet light absorbers are not limited and may be selected accordingly and examples include benzotiazo compounds (U.S. Pat. No. 3,533,794), 4-thiazolidone compounds (U.S. Pat. No. 3,352,681), benzophenone compounds (JP-A No. 46-2784) and ultraviolet light absorbing polymers (JP-A No. 62-260152).

The metal complexes are not limited and may be selected accordingly. Examples can be found in U.S. Pat. Nos. 4,241,155, 4,245,018, 4,254,195, and JP-A Nos. 61-88256, 62-174741, 63-199248, 01-75568, 01-74272.

Ultraviolet absorbers and optical stabilizers described in "Handbook of Rubber and Plastics Additives", Second Edition by Rubber Digest Co. (1993), p. 122-137 can also be used.

The known photographic additives may be added to the materials used for toner image-receiving layer accordingly as described above. Typical disclosure of the photographic additives can be found in, for example, Research Disclosure hereafter called "RD") No. 17643 (December 1978), RD No. 18716 (November 1979) and RD No. 307105 (November 1989) and the pages are shown in Table 1.

TABLE 1

| Types of additives | RD17643 | RD18716 | RD307105 |
|---|---|---|---|
| Whitener | p. 24 | p. 648 right column | p. 868 |
| Stabilizer | pp. 24-25 | p. 649 right column | pp. 868-870 |
| Light absorber, Ultraviolet ray absorber | pp. 25-26 | p. 649 right column | p. 873 |
| Colorant image stabilizer | p. 25 | p. 650 right column | p. 872 |
| Film hardener | p. 26 | p. 651 left column | pp. 874-875 |
| Binder | p. 26 | p. 651 left column | pp. 873-874 |
| Plasticizer, lubricant | p. 27 | p. 650 right column | p. 876 |
| Auxiliary application agent, Surfactant | p. 26-27 | p. 650 right column | pp. 875-876 |
| Antistatic agent | p. 27 | p. 650 right column | pp. 876-877 |
| Matting agent | — | — | pp. 878-879 |

The toner image-receiving layer is formed by applying coating liquids containing thermoplastic resin for toner image-receiving layer using wire coater and drying. The membrane forming temperature (MFT) of thermoplastic resin is preferably higher than the room temperature for preservation before printing and is preferably 100° C. or less for toner particle fixation.

The amount by mass of dried toner image-receiving layer is preferably, for example, 1 g/m$^2$ to 20 g/m$^2$ and more preferably 4 g/m$^2$ to 15 g/m$^2$.

The thickness of toner image-receiving layer can be adjusted accordingly and it is preferably ½ or more or multiples of 1 to 3 of the toner particle diameter. Specifically, it is preferably 1 μm to 50 μm and more preferably 1 μm to 30 μm and still more preferably 2 μm to 20 μm and most preferably 5 μm to 15 μm.

[Physical Properties of Toner Image-receiving Layer]

The 180° peeling strength at the fixing temperature with the fixing members of toner image-receiving layer is preferably 0.1N/25 mm or less and more preferably 0.041N/25 mm or less. The 180° peeling strength can be measured according to the method described in JIS K6887 using surface materials of fixing members.

The toner image-receiving layer having high whiteness level is preferable. It is preferably 85% or more if measured by the method according to JIS P8123. The spectral reflection factor is preferably 85% or more in a wave length area of 440 nm to 640 nm and the difference between the highest and lowest spectral reflection factor in the wave length area is 5% or less. It is more preferably 85% or more in a wave length area of 400 nm to 700 nm and the difference between the highest and lowest spectral reflection factor in the wave length area is 5% or less.

The whiteness degree specifically in the color space of CIE 1976(L*a*b*) is preferably 80 or more and more preferably 85 or more and still more preferably 90 or more. The color tone of whiteness should be neutral as much as possible. The value of $(a^*)^2+(b^*)^2$ in the L*a*b*space is preferably 50 or less and more preferably 18 or less and still more preferably 5 or less.

The high surface gloss of toner image-receiving layer after an image formation is preferred. The 45° surface gloss in the whole region from white without toner to the darkest black is preferably 60 or more and more preferably 75 or more and still more preferably 90 or more.

However, the surface gloss should stay 110 or less because if it exceeds 110, it becomes more like metallic gloss not preferable for image quality.

The surface gloss can be, for example, measured according to JIS Z8741.

It is preferred that the toner image-receiving layer has a high level of smoothness. The arithmetic average roughness (Ra) is preferably 3 μm or less, more preferably 1 mm or less, and still more preferably 0.5 μm or less over the whole range from white without toner to the darkest black.

Arithmetic average roughness may be measured in accordance with JIS B0601, JIS B0651, and JIS B0652.

It is preferred that the toner image-receiving layer has one of the following physical properties, more preferred that it has a plurality of the following physical properties, and most preferred that it has all of the following physical properties.

(1) $T_m$ (Melting temperature) of toner image-receiving layer is 30° C. or more, and equal to or less than $T_m$+20° C. of the toner.

(2) The temperature at which the viscosity of toner image-receiving layer becomes $1\times10^5$ cp is 40° C. or higher, and lower than the corresponding temperature for the toner.

(3) At a fixing temperature of toner image-receiving layer, the storage elasticity modulus (G') is $1\times10^2$ Pa to $1\times10^5$ Pa, and the loss elasticity modulus (G") is $1\times10^2$ Pa to $1\times10^5$ Pa.

(4) The loss tangent (G"/G'), which is the ratio of loss elasticity modulus (G") and storage elasticity modulus (G') at a fixing temperature of toner image-receiving layer, is 0.01 to 10.

(5) The storage modulus (G') at a fixing temperature of toner image-receiving layer is from −50 to +2500, relative to the storage modulus (G') at a fixing temperature of the toner.

(6) The inclination angle on the toner image-receiving layer of molten toner is 50° or less, and particularly preferably 40° or less.

The toner image-receiving layer preferably satisfies the physical properties described in JP-B No. 2788358, and JP-A Nos. 07-248637, 08-305067 and 10-239889.

The surface electrical resistance of toner image-receiving layer is preferably $1\times10^6$ Ω/cm$^2$ to $1\times10^{15}$ Ω/cm$^2$(at 25° C. and 65% RH). When the surface electrical resistance is less than $1\times10^6$ Ω/cm$^2$, the amount of transferred toner on the toner image-receiving layer is possibly not sufficient, and the resulting toner image tends to exhibit a lower density. When it is over $1\times10^{15}$ Ω/cm$^2$, excessive charge is induced more than necessary at the transferring period, resulting in insufficient transfer of toner with the image density becoming lower, and dusts tends to attach on the electrophotographic materials due to static electricity when handling it. Further, miss feed, duplicated conveying, electric discharge trace, and miss transferring may be derived.

Incidentally, the surface electrical resistance may be determined in accordance with JIS K6911, i.e. the sample is allowed to stabilize its moisture in the ambient condition of 20° C. and 65% humidity for 8 hours or more, then the surface electrical resistance is measured after one minute of conducting period with 100 V of applied voltage, under the same ambient condition by means of R8340 (by Advantest K.K).

[Other Layers]

Other layers include surface protective layer, backing layer, contact improving layer, intermediate layer, undercoat layer, cushion layer, charge control (antistatic) layer, reflection layer, color tone adjusting layer, storage property improving layer, antistick layer, anti-curl layer and smoothing layer, and the like, for example. These layers can be single-structured or multiple-structured.

—Surface Protective Layer—

A surface protective layer may be disposed on the surface of the toner image-receiving layer to protect the surface of electrophotographic materials, to improve storage properties, to improve handling ability, to facilitate writing ability, to improve paper conveying properties within an equipment, to confer anti-offset properties, or the like. The surface protective layer may comprise one layer, or two or more layers. In the surface protective layer, various thermoplastic resins or thermosetting resins may be used as binders, and are preferably the same types of resins as those of the toner image-receiving layer. However, the thermodynamic properties and electrostatic properties are not necessarily identical to those of the toner image-receiving layer, and may be individually optimized.

Various additives that are usable for toner image-receiving layers can be added to the surface protective layer. Other additives, for example, the well-known matting agents can be compounded into the surface protective layer with the releasing agents that are used for this invention —Backing Layer—

It is preferred that, in the electrophotographic materials, a backing layer is disposed on the opposite surface of the support on which toner image-receiving layer is disposed, in order to confer a back surface output compatibility, and to improve a back surface output image quality, curling balance and paper conveying properties within the apparatus.

There is no particular limitation on the color of the backing layer. However, if the electrophotographic materials in the invention are double-sided output image-receiving sheets where an image is formed also on the back surface, it is preferred that the backing layer is also white. It is preferred that the whiteness and spectral reflectance of backing layer are 85% or more.

To improve double-sided output compatibility, the backing layer may have an identical structure to that of the toner image-receiving layer. The backing layer may comprise the various additives described above. Among these additives, matting agents and charge control agents are particularly suitable. The backing layer may be a single layer, or may have a laminated structure comprising two or more layers.

Further, if releasing oil is used for the fixing roller or the like, to prevent offset during fixing, the backing layer may have oil absorbing properties.

The thickness of backing layer is preferably 0.1 μm to 10 μm normally.

—Contact Improving Layer—

In the electrostatic image-recording material, it is preferred to dispose a contact improving layer in order to improve the contact between support and toner image-receiving layer. The contact improving layer may contain various additives described above. Of these, crosslinking agents are particularly preferred. Furthermore, to improve accepting properties of toner, it is preferred that the electrophotographic material further comprises a cushion layer between contact improving layer and toner image-receiving layer.

—Intermediate Layer—

An intermediate layer may, for example, be disposed between support and contact improvement layer, between contact improvement layer and cushion layer, between cushion layer and toner image-receiving layer, or between toner image-receiving layer and storage property improvement layer. In case of an electrophotographic material comprising a support, a toner image-receiving layer and an intermediate layer, the intermediate layer may be disposed between support and toner image-receiving layer, for example.

The thickness of electrophotographic materials can be adjusted accordingly and it is preferably from 50 μm to 550 μm and more preferably from 100 μm to 350 μm.

<Toner>

In the electrophotographic material, the toner image-receiving layer receives toners during printing or copying.

The toner contains at least a binder resin and a colorant, and may contain releasing agents and other components, as necessary.

—Binder Resin for Toner—

The binder resin for toner is not limited and may be selected from generally used toners in the art accordingly. Examples of binder resin include vinyl monopolymer of: styrenes such as styrene, parachlorostyrene, or the like; vinyl esters such as vinyl naphthalene, vinyl chloride, vinyl bromide, vinyl fluoride, vinyl acetate, vinyl propionate, vinyl benzoate, vinyl butyrate, or the like; methylene aliphatic carboxylate esters such as methyl acrylate, ethyl acrylate, n-butyl acrylate, isobutyl acrylate, dodecyl acrylate, n-octyl acrylate, 2-chloroethyl acrylate, phenyl acrylate, α-methyl chloroacrylate, methyl methacrylate, ethyl methacrylate, butyl methacrylate, or the like; vinyl nitriles such as acryloniotrile, methacrylonitrile, acrylamide, or the like; vinyl ethers such as vinyl methyl ether, vinyl ethyl ether, vinyl isobutyl ether, or the like; N-vinyl compounds such as N-vinyl pyrrole, N-vinylcarbazole, N-vinyl indole, N-vinyl pyrrolidone, or the like; and vinyl carboxylic acids such as methacrylic acid, acrylic acid, cinnamic acid, or the like. These vinyl monomers may be used either alone, or in the form of copolymers. Further, various polyesters may be used, and various waxes may be used in combination.

Of these resins, it is preferable to use a resin of the same type as the resin used for toner image-receiving layer.

—Colorants for the Toner—

The colorants is not limited and may be selected from generally used colorants in the art accordingly. Examples of colorants include various pigments such as carbon black, chrome yellow, Hansa yellow, benzidine yellow, threne yellow, quinoline yellow, permanent orange GTR, pyrazolone orange, Balkan orange, watch young red, permanent red, brilliant carmin 3B, brilliant carmin 6B, dippon oil red, pyrazolone red, lithol red, rhodamine B lake, lake red C, rose bengal, aniline blue, ultramarine blue, chalco oil blue, methylene blue chloride, phthalocyanine blue, phthalocyanine green, malachite green oxalate, or the like. Various dyes may also be added such as acridine, xanthene, azo, benzoquinone, azine, anthraquinone, thioindigo, dioxazine, thiazine, azomethine, indigo, phthalocyanine, aniline black, polymethine, triphenylmethane, diphenylmethane, thiazine, thiazole, or the like.

These can be used alone or in combination of two or more.

The content of colorant is not limited and may be adjusted accordingly and it is preferably from 2% by mass to 8% by mass. If the content of colorant is less than 2% by mass, coloration may become weaker and if it is more than 8% by mass, transparency may be deteriorated.

—Releasing Agent for Toner—

The releasing agent is not limited and may be selected from generally used for toner in the art accordingly. Polar wax containing nitrogen, highly crystalline polyethylene wax having relatively low molecular mass, Fischertropsch wax, amide wax, urethane wax, and the like are particularly effective. For polyethylene wax, it is particularly effective if the molecular mass is 1,000 or less, and is more preferably if the molecular mass is 300 to 1,000.

Compounds containing urethane bonds sustain a solid state due to the strength of cohesive energy of polar groups despite of their low molecular mass and the melting point can be set high in spite of the molecular mass, thereby being suitable for use. The preferred molecular mass is 300 to 1,000. The raw materials may be selected from various combinations such as diisocyane acid compound with mono-alcohol, monoisocyanic acid with mono-alcohol, dialcohol with mono-isocyanic acid, tri-alcohol with monoisocyanic acid, and triisocyanic acid compound with mono-alcohol. However, in order to prevent the molecular mass from becoming too large, it is preferable to combine a compound having multiple functional groups with another compound having single functional group, and it is preferred that the amount of functional groups be equivalent.

Examples of monoisocyanic acid compounds include dodecyl isocyanate, phenyl isocyanate and derivatives thereof, naphthyl isocyanate, hexyl isocyanate, benzyl isocyanate, butyl isocyanate, allyl isocyanate, and the like.

Examples of diisocyanic acid compounds include tolylene diisocyanate, 4-diisocyanate, 4'-diphenylmethane diisocyanate, toluene diisocyanate, 1,3-phenylene diisocyanate, hexamethylene diisocyanate, 4-methyl-m-phenylene diisocyanate, isophorone diisocyanate, and the like.

Examples of mono-alcohol include methanol, ethanol, propanol, butanol, pentanol, hexanol, heptanol, and the like.

Examples of di-alcohols include numerous glycols such as ethylene glycol, diethylene glycol, triethylene glycol, trimethylene glycol, or the like; and examples of tri-alcohols include trimethylol propane, triethylol propane, trimethanolethane, and the like.

These urethane compounds may be mixed with resin or colorant during kneading, as an ordinary releasing agent, and used also as a kneaded-crushed toner. Further, in case of using an emulsion polymerization cohesion scarification toner, the urethane compounds may be dispersed in water together with polymer electrolytes such as ionic surfactant, polymer acid or polymer base, heated above the melting point, and converted to fine particles by applying an intense shear in a homogenizer or pressure discharge dispersion machine to manufacture a releasing agent with particle dispersion of 1 μm or less, which can be used together with a resin particle dispersion, colorant dispersion, or the like.

—Toner and Other Components—

The toner of this invention may also contain other components such as internal additives, charge control agents, inorganic particles, or the like. Examples of internal additives include metals such as ferrite, magnetite, reduced iron, cobalt, nickel, manganese, or the like; alloys or magnets such as compounds containing these metals.

Examples of charge control agents include dyes such as quaternary ammonium salt, nigrosine compounds, dyes made from complexes of aluminum, iron and chromium, or triphenylmethane pigments. The charge control agent can be selected from ordinary used charge control agents. Materials which are refractory in water are preferred for controlling ionic strength which affects cohesion and stability during melting and for minimizing waste water pollution.

The inorganic fine particles may be any of the external additives generally used for toner surfaces, such as silica, alumina, titania, calcium carbonate, magnesium carbonate, tricalcium phosphate, or the like. It is preferred to disperse these with an ionic surfactant, polymer acid or polymer base.

Surfactants can also be used for emulsion polymerization, seed polymerization, pigment dispersion, resin particle dispersion, releasing agent dispersion, cohesion or stabilization thereof. For example, it is effective to use, in combination, anionic surfactants such as sulfuric acid ester salts, sulfonic acid salts, phosphoric acid esters, soaps, or the like; cationic surfactants such as amine salts, quaternary ammonium salts, or the like; or non-ionic surfactants such as polyethylene glycols, alkylphenol ethylene oxide adducts, polybasic alcohols, or the like. These may generally be dispersed by a rotary shear homogenizer or a ball mill, sand mill, dyno mill, or the like, all of which containing a media.

The toner may also contain external additives as necessary. Examples of external additives include inorganic particles, organic particles, and the like. Examples of inorganic particles include $SiO_2$, $TiO_2$, $Al_2O_3$, CuO, ZnO, $SnO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$, and the like. Examples of organic particles include aliphatic acids, derivatives thereof, and the like, powdered metal salts thereof, and resin powders such as fluorine resin, polyethylene resin, acrylic resin, and the like. The average particle diameter of the powder may be, for example, from 0.01 μm to 5 μm, and is more preferably from 0.1 μm to 2 μm.

The method for manufacturing toner is not specified, however, it is preferably manufactured by the process comprising steps from (i) to (iii). (i) forming cohesive particles in a dispersion of resin particles to manufacture a cohesive particle dispersion, (ii) adding a fine particle dispersion to the cohesive particle dispersion so that the fine particles adhere to the cohesive particles, thus forming adhesion particles, and (iii) heating the adhesion particles which melt to form toner particles.

—Physical Properties of Toner—

It is preferred that the volume average particle diameter of the toner is from 0.5 μm to 10 μm.

If the volume average particle diameter of the toner is too small, it may have an adverse effect on handling toner (supplementation, cleaning properties, fluidability, or the like), and the productivity of the particles may deteriorate. On the other hand, if the volume average particle diameter is too large, it may have an adverse effect on the image quality and resolution resulting from graininess and transfer properties.

It is preferred that the toner satisfies the above volume average particle diameter range, and that the volume average particle size distribution index (GSDv) is 1.3 or less.

It is preferred that the ratio (GSDv/GSDn) of the volume average particle size distribution index (GSDv) and the number average particle size distribution index (GSDn) is 0.95 or more.

It is preferred that the toner satisfies the volume average particle diameter range, and that the average value of the formation coefficient expressed by the following equation is 1.00 to 1.50:

$$\text{Formation coefficient}=(\pi\times L^2)/(4\times S)$$

(where "L" represents the length of the toner particle and "S" represents the projected area of the toner particle.)

If the toner satisfies the above conditions, it has a desirable effect on image quality, and in particular, on graininess and resolution. Also, there is a less risk of dropout and blur accompanying with toner transfer, and a less risk of adverse effect on handling properties, even if the average particle diameter is not small.

The storage elasticity modulus G' (measured at an angular frequency of 10 rad/sec) of the toner itself at 150° C. is from $1\times10^2$ Pa to $1\times10^5$ Pa, which is suitable for improving image quality and preventing offset at the fixing step.

<Heat Sensitive Material>

The heat sensitive material has, for example, a configuration in which at least a thermal-coloring layer is disposed on the support for image-recording material of the invention as an image-recording layer. Examples thereof include, but are not limited to, heat sensitive materials used in thermo-autochrome method (TA method) in which repetition of heating by a heat sensitive head and fixing by ultraviolet ray forms an image.

<Sublimation Transfer Material>

The sublimation transfer material has, for example, a configuration in which at least an ink layer containing a heat-diffusion pigment (subliming pigment) is disposed on the support for image-recording material of the invention as an image-recording layer. The sublimation transfer material is generally used in, for example, a sublimation transfer method in which a heat sensitive head heats an ink layer so as to transfer the heat-diffusion pigment to a sublimation transfer sheet.

<Heat Transfer Material>

The heat transfer material has, for example, a configuration in which at least a heat-melting ink layer as an image-recording layer is disposed on the support for image-recording material of the invention. The heat transfer material is generally used in, for example, a method in which a heat sensitive head heats the heat-melting ink layer so as to melt and transfer the ink to a heat transfer sheet.

<Silver Salt Photographic Material>

The silver salt photographic material has, for example, a configuration in which an image-recording layer which develops at least yellow, magenta and cyan (YMC) is disposed on the support for image-recording material of the invention. The material is generally used in, for example, silver halide photography in which an exposed and printed silver halide photographic sheet is soaked in several process baths one after another so as to perform color developing, bleaching and fixing, washing with water, and drying.

<Inkjet-recording Material>

The inkjet-recording material includes, for example, a colorant-receiving layer disposed on the support for image-recording material of the invention, where the colorant-receiving layer is capable of receiving a liquid ink such as an aqueous ink using a pigment or dye as the colorant and oil ink; a solid ink which is solid at room temperature but is melted and liquefied when used for a print, and the like.

<Printing Paper>

The support for image-recording material is preferably used as a printing paper. In this case, it is preferred that the support has high mechanical strength because inks are applied by printing machines.

The printing paper described above is especially suitable for offset printing and also usable for engraving printing, gravure printing or electrophotographic printing.

The image-recording material of the invention comprises a sharp cutting face, a support for image-recording material with excellent rigidity and water resistance, and an image-recording layer disposed on the support. Because it excels in water resistance and is able to record high-resolution images, it is suitable for electrophotographic material, thermal sensitive material, sublimation transfer material, thermal transfer material, silver salt photographic material, inkjet-recording material, and the like.

Herein below, with referring to Examples and Comparative Examples, the invention is explained in detail and the following Examples and Comparative Examples should not be construed as limiting the scope of this invention. All parts and percentages (%) are expressed by mass unless indicated otherwise.

Example 1

—Production of Support for Image-recording Material—

Pulp slurry was prepared by beating LBKP (broad-leaf kraft pulp, bleaching pulp) to 340 ml of Canadian Standard Freeness using a conical refiner until the mass average fiber length of pulp fiber became 0.65 mm. Relative to 100 parts of prepared pulp slurry, additives were then mixed in the following order: 1.5 parts of cationic starch, 0.4 parts of alkyl ketene dimer (AKD) as a sizing agent, 0.1 parts of styrene acrylic emulsion, 0.3 parts of polyamidepolyamineepichlorohydrin, 0.2 parts of anionic polyacrylamide and 0.1 parts of colloidal silica, thereby preparing a paper material.

AKD comprises an alkyl moiety of a fatty acid, mainly behenic acid derivative.

The prepared paper material was subjected to the papermaking using a Fourdrinier papermaking machine to produce a raw paper having a basis mass of 160 g/m$^2$.

During drying in the Fourdrinier papermaking machine, surface A, the front surface, of obtained raw paper was coated respectively with a carboxy-modified polyvinyl alcohol (PVA) in the amount of 1.2 g/m$^2$ and with $CaCl_2$ in the amount of 0.7 g/m$^2$ using a size press apparatus to dry obtained raw paper.

At the end of the Fourdrinier papermaking machine, dried raw paper was subjected to a calendar process where the metal roll surface temperature of surface A is 120° C. and the resin roll surface temperature of surface B is 50° C., thereby controlling the density of raw paper to be 0.98 g/cm$^3$.

Surface A of prepared paper was cast coated making a coat layer with the amount of coating adjusted to 15.0 g/m$^2$ as described below.

<Composition of Coating Liquid for Coat Layers>

| | |
|---|---|
| Clay/styrene acrylate hollow microparticle | 70/30 parts |
| Polyphosphorous Na | 0.5 parts |
| Casein | 8 parts |
| Polyethylene/Wax emulsion with the fusing point of 79° C. | 6 parts |
| Ammonium zirconium carbonate | 3 parts |
| Tributyl phosphate | 0.5 parts |
| Turkey-red oil | 1 part |

Opacity of produced paper was 96% according to JIS P8238.

Whiteness by Hunter was 90%.

In the next process, after corona discharge process was performed on the surface A of the paper, a melting two-layer coextrusion coating was performed by a coextrusion machine, making the thickness of low-density polyethelene (LDPE) containing 8% of titanium dioxide as the first polymer-coated layer (lower layer) 20 μm and the thickness of LDPE containing 15% of titanium dioxide as the second polymer-coated layer (upper layer) 10 μm.

Similarly, after performing a corona discharge process on the surface B of the paper, a melting two-layer coextrusion coating was performed by a coextrusion machine, making the thickness of polyethelene composition, of which that the low-density polyethelene (LDPE) containing 8% of titanium dioxide/high density polyethelene (HDPE)=3/7 as the 3rd polymer-coated layer (lower layer), to become 20 μm and the thickness of polyethelene composition, of which that the low-density polyethelene (LDPE) containing 15% of titanium dioxide/high density polyethelene (HDPE)=3/7 as the 4th polymer-coated layer (upper layer), to become 10 μm.

After performing a melting two-layer coextrusion coating on the surface A and B of the paper, a surface roughening process was performed by using a tilt roller having matte surfaces of different roughness.

Each surface gloss of outermost surfaces of surface A and B of polymer-coated layer after the above-mentioned surface roughening process was 62% for surface A and 25% for surface B according to JIS P8142.

EXAMPLE

Example 2

—Production of Support for Image-recording Material—

A support for image-recording material was produced in the Example 2 similarly to Example 1, except for conditions of the following: paper in Table 2, polymer-coated layers of surface A and B and the surface roughness of the tilt roller which can be altered by controlling the size of the particulates and the blow-pressure when the surface of the tilt roller is blasted in high speed with particulates such as sand, and the like in sandblasting.

Similar to Example 1, the opacity of paper and each surface gloss of outermost surfaces of surface A and B of Example 2 were measured. Results are shown in Table 3.

Example 3

—Production of Support for Image-recording Material—

A support for image-recording material was produced in the example 3 similarly to Example 1, except for conditions of the following: paper in Table 2, polymer-coated layers of surface A and B and the surface roughness of tilt roller which can be altered by controlling the size of the particulates and the blow-pressure when the surface of the tilt roller is blasted in high speed with particulates such as sand, and the like in sandblasting.

Similar to Example 1, the opacity of paper and each surface gloss of outermost surfaces of surface A and B of Example 3 were measured. Results are shown in Table 3.

Example 4

—Production of Support for Image-recording Material—

A support for image-recording material was produced in the Example 4 similarly to Example 1, except for conditions of the following: paper in Table 2, polymer-coated layers of surface A and B and the surface roughness of tilt roller which can be altered by controlling the size of the particulates and the blow-pressure when the surface of the tilt roller is blasted in high speed with particulates such as sand, and the like in sandblasting.

Similar to Example 1, the opacity of paper and the surface gloss of outermost surfaces of surface A and B of Example 4 were measured. Results are shown in Table 3.

Comparative Example 1

—Production of Support for Image-recording Material—

Support for image-recording material was produced in the Comparative Example 1 similarly to Example 1, except for conditions of the following: paper in Table 2, polymer-coated layers of surface A and B and the surface roughness of the tilt roller which can be altered by controlling the size of the particulates and the blow-pressure when the surface of the tilt roller is blasted in high speed with particulates such as sand, and the like in sandblasting.

Similar to Example 1, the opacity of paper and each surface gloss of outermost surfaces of surface A and B of Comparative Example 1 were measured. Results are shown in Table 3.

Comparative Example 2

—Production of Support for Image-recording Material—

Support for image-recording material was produced in the Comparative Example 2 similarly to Example 1, except for altering conditions of the paper in Table 2 and the polymer-coated layers of surface A and B and omitting the surface roughening process of surface A and B by the use of mirror-finished roller as a tilt roller.

Similar to Example 1, the opacity of paper and each surface gloss of outermost surfaces of surface A and B of Comparative Example 2 were measured. Results are shown in Table 3.

Comparative Example 3

—Production of Support for Image-recording Material—

Support for image-recording material was produced in the Comparative Example 3 similarly to Example 1, except for altering conditions of the paper in Table 2 and the polymer-coated layers of surface A and B and omitting the surface roughening process of surface A and B by the use of mirror-finished roller as a tilt roller.

Similar to Example 1, the opacity of paper and each surface gloss of outermost surfaces of surface A and B of Comparative Example 3 were measured. Results are shown in Table 3.

Comparative Example 4

—Production of Support for Image-recording Material—

Support for image-recording material was produced in the Comparative Example 4 similarly to Example 1, except for altering conditions of the paper in Table 2 and the polymer-coated layers of surface A and B and omitting the surface roughening process of surface A and B by the use of mirror-finished roller as a tilt roller.

Similar to Example 1, the opacity of paper and each surface gloss of outermost surfaces of surface A and B of Comparative Example 4 were measured. Results are shown in Table 3.

Comparative Example 5

—Production of Support for Image-recording Material—

Support for image-recording material was produced in the Comparative Example 5 similarly to Example 1, except for conditions of the paper shown in Table 2, polymer-coated layers of surface A and the surface roughness of the tilt roller which can be altered by controlling the size of the particulates and the blow-pressure when the surface of the tilt roller is blasted in high speed with particulates such as sand, and the like in sandblasting.

Similar to Example 1, the opacity of paper and the surface gloss of outermost surface of surface A of Comparative Example 5 were measured. Results are shown in Table 3.

TABLE 2

| | Paper | | Polymer-coated layer on surface A | | | | Polymer-coated layer on surface B | | | |
|---|---|---|---|---|---|---|---|---|---|---|
| | | | Amount of Titanium dioxide | | Thickness | | Amount of Titanium dioxide | | Thickness | |
| | Raw Paper | Amount of | (% by mass) | | (μm) | | (% by mass) | | (μm) | |
| | Basic Mass ($g/m^2$) | Coating ($g/m^2$) | Lower layer | Upper layer | Lower layer | Upper layer | Lower layer | Upper layer | Lower layer | Upper layer |
| Example 1 | 160 | 15 | 8 | 15 | 20 | 10 | 8 | 15 | 20 | 10 |
| Example 2 | 170 | none | 8 | 15 | 20 | 10 | 8 | 15 | 20 | 10 |
| Example 3 | 160 | 15 | 10 | 12 | 15 | 15 | 8 | 15 | 20 | 10 |
| Example 4 | 170 | none | 10 | 12 | 15 | 15 | 8 (Single layer) | | 30 (Single layer) | |
| Example 5 | 145 | none | 8 | 15 | 20 | 10 | 8 | 15 | 20 | 10 |
| Comparative Example 1 | 170 | none | none | | 30 (single layer) | | none | | 30 (single layer) | |
| Comparative Example 2 | 170 | none | 10 | 12 | 15 | 15 | 10 | 12 | 15 | 15 |
| Comparative Example 3 | 145 | none | none | | 30 (single layer) | | none | | 30 (single layer) | |
| Comparative Example 4 | 145 | none | 10 | 12 | 15 | 15 | none | | 30 (single layer) | |
| Comparative Example 5 | 110 | none | 8 (single layer) | | 30 (single layer) | | none | | | |

The adhesion resistance of supports for image-recording materials produced in the Examples from 1 to 5 and Comparative Examples from 1 to 5 were evaluated as described below. The results are shown in Table 3.

<Adhesion Resistance Evaluation>

In a specified condition: 40° C. and 80% RH, surface A and B of each support that had been cut in A4 size were lapped over one another and were loaded with mass of 500 g at 3.5 cm×3.5 cm. The condition was evaluated when they were detached from each other after being left for 7 days in the same environment in accordance with the standards shown below.

The one with the best adhesion resistance was assigned A, followed by B, C, D and E on the following basis.

[Evaluation Standards]

A Very good (No peeling sound or adhesive remains)
B Good (minor peeling sound or adhesive remains)
C Mediocre (Less than ¼ of adhesive remains)
D Poor (¼ to ½ or less of adhesive remains)
E Very poor (½ or more of adhesive remains)

TABLE 3

| | Paper Opacity | Polymer-coated Layer on surface A Surface Surface gloss | Polymer-coated Layer on surface B Surface Surface gloss | Adhesion Resistance |
|---|---|---|---|---|
| Example 1 | 96 | 62 | 25 | A |
| Example 2 | 92 | 62 | 61 | B |
| Example 3 | 96 | 62 | 24 | A |
| Example 4 | 92 | 71 | 15 | A |
| Example 5 | 89 | 61 | 25 | A |
| Comparative Example 1 | 92 | 62 | 25 | A |
| Comparative Example 2 | 92 | 85 (no roughening) | 85 (no roughening) | E |
| Comparative Example 3 | 89 | 85 (no roughening) | 85 (no roughening) | E |
| Comparative Example 4 | 89 | 85 (no roughening) | 85 (no roughening) | E |
| Comparative Example 5 | 78 | 24 | none | A |

Examples 6 to 10 and Comparative Examples 6 to 10

Each image-receiving paper for electrophotography of Examples from 6 to 10 and Comparative Examples from 6 to 10 was produced according to the following methods by using each support for image-recording material from Examples from 1 to 5 and Comparative Examples from 1 to 5.

—Titanium Dioxide Dispersion Solution—

The following components: 40.0 g of titanium dioxide (Tipaque (registered mark) A-220 by Ishihara Sangyo Kaisha Ltd.), 2.0 g of polyvinyl alcohol (PVA102 by Kuraray Co., Ltd.), 58.0 g of ion exchange solution, were mixed and dispersed by using NBK-2 by Nihon Seiki Seisakujo to prepare a titanium dioxide dispersion solution containing 40% by mass of titanium dioxide pigments.

—Preparation of Coating Liquid for Toner Image-receiving Layer—

The following components: 15.5 g of titanium dioxide dispersion solution, 15.0 g of carnauba wax dispersion solution (Cellosol 524 by Chukyo Yoshi Co., Ltd.), 100.0 g of polyester resin aqueous dispersion (solids 30% by mass, KZA-7049 by Unitika Ltd.), 2.0 g of viscosity-enhancing agent (Alkox E30 by Meisei Chemical Works, Ltd.), 0.5 g of anion surface-active agent (AOT) and 80 ml of ion exchange water, were mixed and stirred to prepare a coating liquid for toner image-receiving layer.

Resulting coating solution had a viscosity of 40 mPa·s and a surface tension of 34 mN/m.

—Coating Toner Image-receiving Layer—

Coating liquid for toner image-receiving layer was applied using a bar coater on each surface A and B of each support for image-recording material from Examples from 1 to 5 and Comparative Examples from 1 to 5, adjusting the dry mass to become 12 g/m$^2$ to produce toner image-receiving layers. The amount of pigments contained in the toner image-receiving layer was 5% by mass relative to the thermoplastic resin.

Both surface A and B of toner image-receiving layers were then dried by hot air, online after coating. Airflow and temperature for drying surfaces as well as the toner image-receiving layers were adjusted, so that they would be dried within 2 minutes after coating. The point of dryness was determined from the point where the surface temperature of the coating becomes equal to the wet-bulb temperature of dry airflow.

After drying, a calender process was performed. A gloss calender was used for the calender process at the temperature of metal roller maintaining 40° C. and the nip pressure of 14.7 kN/cm$^2$.

Each of the obtained electrophotographic image-receiving paper was cut to A4 size, and an image was printed on surface A by using a printer for electrophotography. The image was then printed on surface B by using a printer for electrophotography. The printer used here was a color laser printer, DocuColor 1250-PF by Fuji Xerox Co., Ltd., its fixing part being the belt fixing apparatus 1 shown in the FIG. 4.

Figure 4:
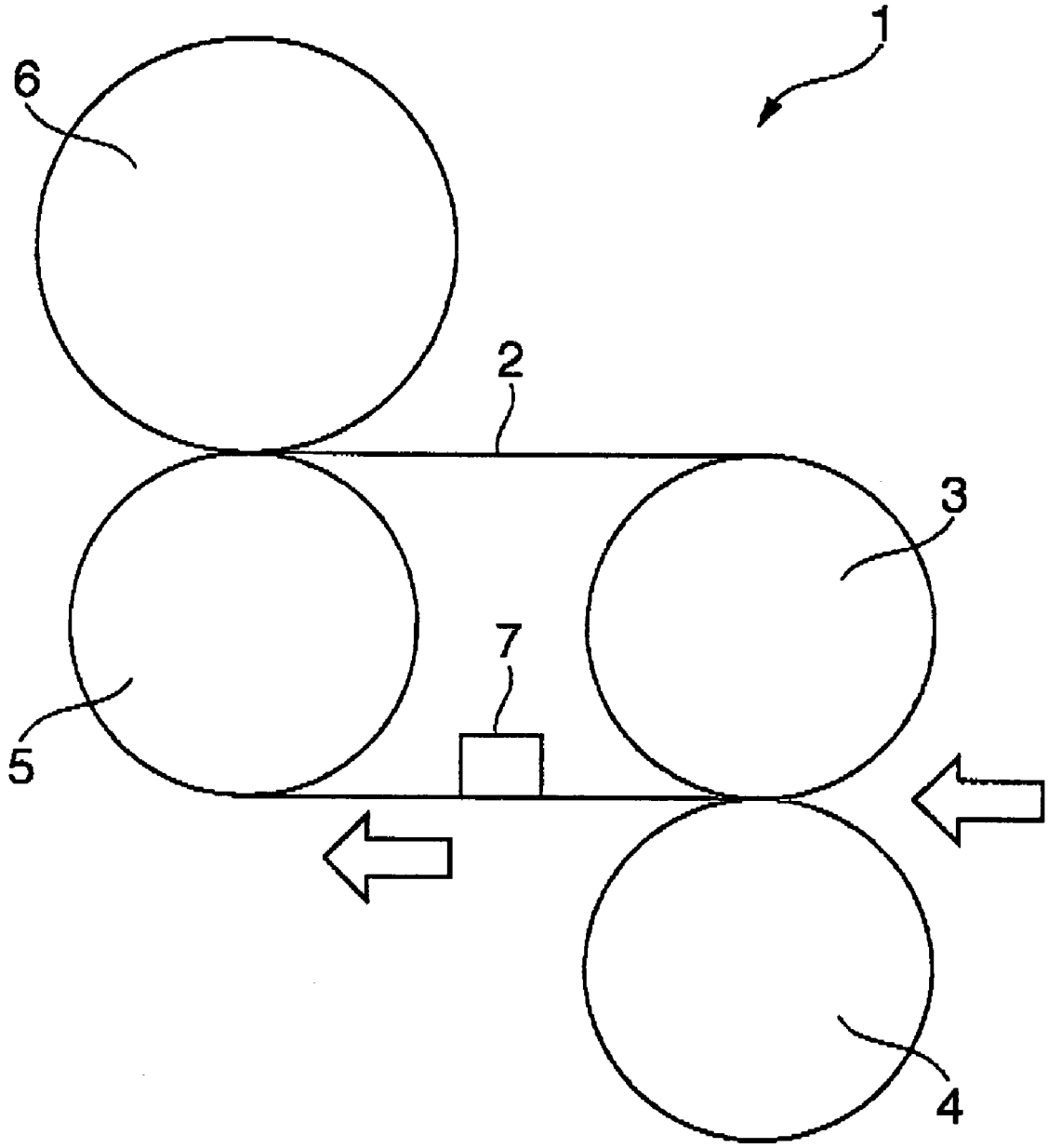
FIG. 4 is a schematic view showing a belt fixation device in the image formation equipment used in the Examples of the invention.

Specifically, in the apparatus having the belt fixing apparatus 1 as shown in FIG. 4, the fixing belt 2 is suspended around the heating roller 3 and the tension roller 5. The cleaning roller 6 is provided via fixing belt 2 above tension roller 5, and the pressurizing roller 4 is further provided via the fixing belt 2 below the heating roller 3. In FIG. 4, starting from the right-hand side, the electrophotographic image-receiving sheet carrying a toner latent image was introduced between heating roller 3 and pressurizing roller 4, and fixed and transported on the fixing belt 2. Thereafter, in this process, the toner latent image was cooled by the cooling device 7, and was finally cleaned by the cleaning roller 6.

In the belt fixing apparatus 1, the conveying speed of the fixing belt 2 was 30 mm/sec, the nip pressure between heating roller 3 and pressurizing roller 4 was 0.2 MPa and the temperature of the heating roller 3 was 150° C. corresponding to the fixing temperature. The temperature of the pressurizing roller 4 was set at 120° C.

For each electrophotographic print obtained, image quality, surface gloss and show-through level were evaluated in the following manner. Results are shown in Table 4.

<Image Quality Evaluation>

The image quality of surface A and B of each electrophotographic print was visually observed and evaluated. The print with the best image quality was assigned A, followed by B, C, D and E on the following standards.

[Evaluation Standards]

A Very good (Sufficient for high-image-quality-recording material)

B Good (Sufficient for high-image-quality-recording material)

C Mediocre (Insufficient for high-image-quality-recording material)

D Poor (Insufficient for high-image-quality-recording material)

E Very poor (Insufficient for high-image-quality-recording material)

<Surface Gloss Evaluation>

Each surface gloss of surface A and B of electrophotographic prints was visually observed and evaluated. The print with the best surface gloss was assigned A, followed by B, C, D and E on the following standards.

[Evaluation Standards]

A Very good (Sufficient for high-image-quality-recording material)

B Good (Sufficient for high-image-quality-recording material)

C Mediocre (Insufficient for high-image-quality-recording material)

D Poor (Insufficient for high-image-quality-recording material)

E Very poor (Insufficient for high-image-quality-recording material)

<Show-through Level Evaluation>

The show-through level of each surface A and B of electrophotographic prints was visually observed and evaluated. The print with the least show-through level was assigned A, followed by B, C, D and E on the following standards.

[Evaluation Standards]

A Very good

B Good

C Mediocre

D Poor

E Very poor

TABLE 4

| | | Image Quality | | Surface gloss | | |
|---|---|---|---|---|---|---|
| | Support | Surface A | Surface B | Surface A | Surface B | Show-through |
| Example 6 | Example 1 | A | A | A | B | A |
| Example 7 | Example 2 | A | A | A | A | A |
| Example 8 | Example 3 | A | A | A | B | A |
| Example 9 | Example 4 | A | B | A | B | A |
| Example 10 | Example 5 | A | A | A | A | B |
| Comparative Example 6 | Comparative Example 1 | D | D | A | A | B |
| Comparative Example 7 | Comparative Example 2 | A | A | C | C | A |
| Comparative Example 8 | Comparative Example 3 | D | D | C | C | C |
| Comparative Example 9 | Comparative Example 4 | A | D | C | C | B |
| Comparative Example 10 | Comparative Example 5 | B | E | B | D | D |

A support for image-recording material of the invention is recordable on both surfaces with less show-through, has an excellent adhesion resistance and texture, and can record high gloss, high quality images. It is suitably used for various image-recording material, for example, electrophotographic material, thermosensitive material, sublimation transfer material, thermal transfer material, silver salt photographic material, inkjet-recording material, and the like.

An image-recording material of the invention, by having a support for image-recording material of the invention, can be suitably used for electrophotographic material, thermosensitive material, sublimation transfer material, thermal transfer material, silver salt photographic material, inkjet-recording material, and the like.

What is claimed is:

1. An image-recording material comprising:

a support for the image-recording material; and at least one toner-image receiving layer on both surfaces of the support, wherein the support comprises a paper, and at least one polymer-coated layer on both surfaces of the paper, wherein each polymer-coated layer on both surfaces of the paper comprises titanium dioxide, and each outermost surface of polymer-coated layers on both surfaces of the paper is a roughened surface.

2. The image-recording material according to claim 1, wherein the paper of the support comprises a raw paper.

3. The image-recording material according to claim 2, wherein the paper comprises the raw paper and a coat layer on at least one surface of the raw paper, and the coat layer comprises a pigment and an adhesive.

4. The image-recording material according to claim 3, wherein the coat layer of the support is a cast-coated layer.

5. The image-recording material according to claim 1, wherein the surface gloss of at least one of the roughened surfaces of the support is 5% to 65%, based on JIS P8142.

6. The image-recording material according to claim 1, wherein two or more polymer-coated layers are disposed on the both surfaces of the paper of the support, and the content of titanium dioxide in the site of the polymer-coated layer furthermost from the paper is greater than the content of titanium dioxide in the site of the polymer-coated layer adjacent to the paper.

7. The image-recording material according to claim 6, wherein the content of titanium dioxide in the site of the polymer-coated layer furthermost from the paper of the support is 10% by mass to 20% by mass and the content of titanium dioxide in the site of the polymer-coated layer adjacent to the paper is 10% by mass or less.

8. The image-recording material according to claim 1, wherein the opacity of the paper is 91% or more, based on JIS P8238.

9. The image-recording material according to claim 1, wherein the Hunter whiteness of the paper of the support is 85% or more.

10. The image-recording material according to claim 1, wherein the roughened surface of the support is one selected from a matte surface, a semi matte surface, a microscopic matte surface, an embossed surface, a lustered surface, and a combination thereof.

11. The image-recording material according to claim 1, wherein the polymer-coated layer comprises a polyolefin resin.

12. The image-recording material according to claim 1, wherein the image-recording material is selected from the group consisting of electrophotographic materials, heat-sensitive materials, sublimation transfer materials, thermal transfer materials, silver salt photographic materials and inkjet-recording materials.

13. The image-recording material according to claim 1, wherein the image-recording material is recordable on both surfaces.

* * * * *